US005342730A

United States Patent [19]

Welter et al.

[11] Patent Number: 5,342,730

[45] Date of Patent: * Aug. 30, 1994

[54] DYE RELEASING COUPLERS FOR COLOR DIFFUSION TRANSFER ELEMENTS WITH DYE BARRIER LAYERS

[75] Inventors: Thomas R. Welter, Webster; John Texter, Rochester, both of N.Y.

[73] Assignee: Eastman Kodak Company, Rochester, N.Y.

[ * ] Notice: The portion of the term of this patent subsequent to Feb. 22, 2011 has been disclaimed.

[21] Appl. No.: 952,444

[22] Filed: Sep. 28, 1992

[51] Int. Cl.[5] ..... G03C 5/54

[52] U.S. Cl. ..... 430/213; 430/214; 430/220; 430/226; 430/237

[58] Field of Search ..... 430/212, 214, 220, 226, 430/227, 213

[56] References Cited

U.S. PATENT DOCUMENTS

| | | | |
|---|---|---|---|
| 3,220,835 | 11/1965 | Land . | |
| 3,227,550 | 1/1966 | Whitmore et al. | 430/226 |
| 3,615,421 | 10/1971 | Land . | |
| 3,730,718 | 5/1973 | Dannhauser . | |
| 3,743,504 | 7/1973 | Dappen et al. . | |
| 3,888,669 | 6/1975 | Cardone . | |
| 4,055,429 | 10/1977 | Holmes et al. . | |
| 4,060,417 | 11/1977 | Cieciuch et al. . | |
| 4,141,730 | 2/1979 | Minagawa et al. | 430/504 |
| 4,202,694 | 5/1980 | Taylor . | |
| 4,248,962 | 2/1981 | Lau | 430/544 |
| 4,267,265 | 5/1981 | Sugimoto et al. | 430/523 |
| 4,317,892 | 3/1982 | Abel | 525/194 |
| 4,328,301 | 5/1982 | Wright | 430/215 |
| 4,401,746 | 8/1983 | Pfingston | 430/215 |
| 4,407,929 | 10/1983 | Boie et al. | 430/212 |
| 4,429,033 | 1/1984 | Boie et al. | 430/212 |
| 4,450,224 | 5/1984 | Klein et al. | 430/213 |
| 4,459,346 | 7/1984 | Bishop et al. | 430/215 |
| 4,485,165 | 11/1984 | Finn et al. | 430/212 |
| 4,504,569 | 3/1985 | Abel et al. | 430/214 |
| 4,508,809 | 4/1985 | Boie et al. | 430/220 |
| 4,636,455 | 1/1987 | Aono et al. | 430/213 |
| 4,680,247 | 7/1987 | Murphy | 430/215 |
| 4,740,496 | 4/1988 | Vanier | 503/227 |
| 4,774,162 | 9/1988 | Shibata et al. | 430/213 |
| 4,840,884 | 6/1989 | Mooberry et al. | 430/559 |
| 4,865,946 | 9/1989 | Bowman et al. | 430/215 |
| 5,023,162 | 6/1991 | Yamanouchi et al. | 430/213 |
| 5,112,720 | 5/1992 | Karino | 430/214 |

FOREIGN PATENT DOCUMENTS

| | | |
|---|---|---|
| 0144059B1 | 2/1989 | European Pat. Off. . |
| 0115303B1 | 10/1989 | . |

*Primary Examiner*—Richard L. Schilling
*Attorney, Agent, or Firm*—Paul A. Leipold

[57] ABSTRACT

In accordance with this invention a photographic color diffusion transfer element and process for its development are provided. The element comprises a single dimensionally stable support, wherein said support comprises an opaque and light reflecting layer, and coated thereon in reactive association and in sequence (1) a mordant layer for binding diffusible dyes, (2) a stripping layer, (3) one or more layers comprising radiation sensitive silver halide and a diffusible-dye forming coupler, and (4) a barrier layer comprising a polymer that (a) allows the passage of solutions for processing said element when said element is contacted with an external processing bath and (b) impedes the diffusion out of said element of the diffusible dye formed from said diffusible-dye forming coupler, and wherein said diffusible-dye forming coupler is of the structure Cp-L-Dye wherein Cp is a coupler radical selected from the group comprising cyan dye forming radicals, magenta dye forming radicals, yellow dye forming radicals, black dye forming radicals, and colorless product forming radicals, said Cp being substituted in the coupling position with a divalent linking group, L;

Dye is a dye radical exhibiting selective absorption in the visible spectrum and contains a solubilizing group;

and where said -L-Dye group couples off upon reaction of said coupler radical with the oxidation product of a primary amine developing agent. In (Abstract continued on next page.)

another preferred embodiment, said element comprises a single dimensionally stable transparent support, and coated thereon in reactive association and in sequence (1) a mordant layer for binding diffusible dyes, (2) an opacifying light reflecting layer, (3) one or more layers comprising radiation sensitive silver halide and a diffusible-dye forming coupler, and (4) a barrier layer comprising a polymer that (a) allows the passage of solutions for processing said element when said element is contacted with an external processing bath and (b) impedes the diffusion out of said element of the diffusible dye formed from said diffusible-dye forming coupler. In another preferred embodiment, said element comprises a single dimensionally stable transparent support, and coated thereon in reactive association and in sequence (1) one or more layers comprising radiation sensitive silver halide and a diffusible-dye forming coupler, (2) an opacifying light reflecting layer, (3) a mordant layer for binding diffusible dyes, and (4) a barrier layer comprising a polymer that (a) allows the passage of solutions for processing said element when said element is contacted with an external processing bath and (b) impedes the diffusion out of said element of the diffusible dye formed from said diffusible-dye forming coupler.

50 Claims, No Drawings

DYE RELEASING COUPLERS FOR COLOR DIFFUSION TRANSFER ELEMENTS WITH DYE BARRIER LAYERS

FIELD OF THE INVENTION

This invention relates to photographic imaging systems that utilize silver halide based radiation sensitive layers and associated formation of image dyes in a wet development process and to systems which utilize polymeric barter layers to control diffusion of particular components. In particular, this invention relates to such systems where the resulting dyes, when the photographic elements are substantially wet, have substantial solubility and freedom to diffuse. More particularly, this invention relates to color diffusion transfer systems that utilize large volume development processing baths.

BACKGROUND OF THE INVENTION

Conventional Wet Silver Halide Processes

In conventional wet processing of silver halide based color photographic elements, an imagewise exposed element, for example color paper designed to provide color prints, is processed in a large volume of color developer solution. The element is typically immersed in a deep tank of processing solution wherein the volume of solution is much greater than the volume of the element therein immersed and wherein the volume of solution is much greater than the swollen volume of the light sensitive emulsion layers coated upon the photographic element. The developer typically reduces the exposed silver halide of the element to metallic silver and the resulting oxidized color developer reacts with incorporated dye-forming couplers to yield dye images corresponding to the imagewise exposure. Since silver is generally gray and desaturates the pure colors of the dyes, it is desirable to remove it from the dye images. Silver is conventionally separated from the dye images by a process of bleaching the silver to a silver halide and removing the silver halide by using a fixing bath. This fixing bath also removes the undeveloped silver halide. Commonly, the bleach and fix are combined into one solution, a bleach-fix solution.

Color Diffusion Transfer Systems

Diffusion transfer processes in photography are well known. Cieciuch et al., in U.S. Pat. Nos. 3,719,489 and 4,060,417, describe photographic processes employing certain compounds which are stable in photographic processing composition but capable of undergoing cleavage in the presence of an imagewise distribution of silver ions created during processing of a silver halide emulsion to liberate a photographically active reagent or a dye in an imagewise distribution corresponding to that of said silver ions. Depending on the photographic process and the result it is desired to achieve the inert parent compound may be diffusible or substantially nondiffusible in the processing solution and the reagent liberated also may be diffusible or substantially nondiffusible in the processing composition.

Land, in U.S. Pat. No. 3,615,421, Taylor, in U.S. Pat. No. 4,202,694, and Murphy, in U.S. Pat. No. 4,680,247, disclose laminated multilayer diffusion transfer film units that comprise two supports (forming the outer surfaces of the respective units). One of said supports is a transparent support (through which the final color dye image is observed, and the other of said supports is usually an opaque support or a transparent support with an adjacent opaque layer. Processing fluids in such film units are dispersed from rupturable pods between various layers inside said units.

Pfingston, in U.S. Pat. No. 4,401,746, discloses a diffusion transfer element comprising in order a topcoat protective layer, light-sensitive and dye providing layers, a stripping layer, a dyeable stratum, and a support. The processing composition may be applied to the exposed photosensitive element by dipping. The developing agent may be any of those commonly employed. The dyeable stratum together with any other image-receiving components are separable from the photosensitive component using the stripping layer.

Boie et al., in U.S. Pat. No. 4,429,033, disclose a process for color print production by diffusion transfer, wherein the diffusion transfer element comprises, in order, a transparent layer support, a light-sensitive element comprising silver halide and a non-diffusing color-providing compound, a light-reflecting opaque layer, and a mordant layer. After development, silver and silver halide are removed by bleaching and fixing. Boie et at., in U.S. Pat. No. 4,508,809, disclose a process and apparatus for exposing and developing photographic images in a diffusion transfer elements. Said element comprises a monosheet material containing a layer which is impermeable to light but permeable to moisture. Said layer divides said element into a photosensitive side for image-wise exposure and a non-photosensitive side for observation and supplying of activator or developer solution. The photosensitive side of said element is exposed image-wise in the dark and then sealed in said apparatus in a light-proof manner, whereby the non-photosensitive side of the element lies open and is exposed to an activator to develop the image. Said exposure to activator may be done in daylight, and once the image quality has been achieved, development is stopped by removal of activator, rinsing, and drying the element in the conventional manner.

Finn and DeBoer, in U.S. Pat. No. 4,485,165, disclose diffusion transfer elements for producing monochromatic dye images comprising (1) a support having thereon a layer of nondiffusible dye image-providing material, a stripping layer, an opaque layer, and a silver halide emulsion layer; (2) a transparent cover sheet; and (3) an opaque processing composition for application between the element and cover sheet. A dye mordant layer may also be present on the element or cover sheet. After exposure and processing, the layer of nondiffusible dye image-providing material on a support is stripped away to provide a monochromatic retained dye image without the need for bleaching and fixing.

Karino, in U.S. Pat. No. 5,112,720, discloses a color diffusion transfer film unit comprising (1) a support having a light-shielding function in itself and/or having thereon a layer having a light-shielding function; (2) a light sensitive element on the support comprising, in order from the support at least (a) a color image receiving layer, (b) a peeling layer, and (c) at least one silver halide emulsion layer associated with a color image-forming substance; (3) a light-shielding agent containing alkali processing composition; and (4) a cover sheet comprising at least a layer having a neutralizing function on a tranparent support, wherein said cover sheet is characterized by having a dye-trapping layer comprising a mordant in a binder adjacent to the alkali processing composition.

Mordants

Klein et al., in U.S. Pat. No. 4,450,224, disclose polymers comprising repeating units derived from $\alpha,\beta$-ethylenically unsaturated monomers, acrylonitrile or methacrylonitrile repeating units, alkyl substituted imidazole repeating units, and similar imidazolium repeating units. Nakamura et at., in U.S. Pat. No. 4,594,308 and in European Patent Specification 144,059 B1, disclose polymeric mordants comprising a monomer unit having an imidazole ring and comprising a monomer unit having a sulfinic acid group. Said mordants provide improved light and thermal stability for dyes attached thereto. Aono et al., in U.S. Pat. No. 4,619,883, disclose the use of terpolymers as dye fixing materials, wherein said terpolymers comprise imidazole and imidazolium repeating units. Aono et at., in U.S. Pat. No. 4,636,455, disclose a variety of polymeric mordants suitable for use as dye fixing materials in diffusion transfer systems. Such polymers typically contain vinyl monomer units having tertiary amino groups or quaternary amino groups. Nakamura et al., in U.S. Pat. No. 4,766,052, disclose polymeric mordants which comprise imidazole containing repeating units and comprising repeating units from at least one of three types of modified ethylenic groups. Shibata and Hirano, in U.S. Pat. No. 4,774,162, disclose polymeric mordants which comprise imidazole ring containing repeating units and comprising repeating units derived from at least one of three types of alkoxide modified ethylenic groups.

Stripping Layers

Land, in U.S. Pat. No. 3,220,835, discloses a stripping layer in a silver halide diffusion transfer process. Said stripping layer may comprise gum arabic, sodium alginate, pectin, cellulose acetate hydrogen phthalate, polyvinyl alcohol, hydroxyethyl cellulose, polymethacrylic acid, plasticized methyl cellulose, ethyl cellulose methyl methacrylate, or butyl methacrylate. Said process comprises an assemblage wherein alkaline processing fluid is distributed intermediate the photosensitive silver halide layers and the receiving layers.

Dannhauser, in U.S. Pat. No. 3,730,718, discloses a dye diffusion transfer process which comprises a multilayer material comprising a stripping layer. Said stripping layer is arranged intermediate the diffusible dye forming layers and the image receiving layer. After development the stripping layer should provide for easy separation between the dye receiving layers and the diffusible dye forming layers. The stripping layer therefore should consist of a material which is soluble in the aqueous alkaline processing solution or becomes soft in this solution. Water soluble or alkali soluble derivatives of cellulose or related materials such as hydroxyethyl cellulose, cellulose acetate hydrogen phthalate, and sodium alginate. Water soluble synthetic polymers such as polyvinyl alcohol are also suitable.

Tsuji et al., in U.S. Pat. No. 3,820,999, disclose the use of polyaddition products of bisacrylamides and diamines in formulating improved stripping layers for silver halide diffusion transfer processes.

Bishop et al., in U.S. Pat. No. 4,459,346, disclose the use of certain straight chain alkyl or polyethylene oxide perfluoroalkylated esters and perfluoroalkylated ethers as stripping agents in diffusion transfer assemblages. These stripping agents were examined with respect to their performance in dry stripping and compared with other stripping agents such as hydroxyethyl cellulose, perfluoronated alkylpolyoxyethylene ether, ethoxylated fluoroalkyl nonionic surfactant, Aerosol TR (sodium bis[tridecyl]sulfosuccinate), polyethylene glycol, and various other anionic and nonionic fluoroalkyl surfactants. Similar agents have been described as release agents by Vanier in U.S. Pat. No. 4,740,496. Such release agents have been used to aid the release of dye-donor and dye-receiver elements in thermal dye transfer assemblages. Cope and Chaikin, in U.S. Pat. No. 3,779,768, disclose the use of such agents in vesicular films to improve sensitivity while maintaining small vesicle size. Bloom and Rogers, in U.S. Pat. No. 3,806,346, disclose the use of the ammonium salt of perfluorooctanoic acid in an integral diffusion transfer film unit to suppress triboluminescence during stripping. Sugimoto et at., in U.S. Pat. No. 4,267,265, disclose the use of organic fluoro-compounds in surface layers of photographic materials to improve anti-adhesion and anti-static properties of such materials.

Wright, in U.S. Pat. No. 4,328,301, discloses stripping layers in diffusion transfer elements wherein said layers comprise graft copolymers of gelatin. Such stripping layers purportedly exhibit good dry adhesion to emulsion layers and moderate wet adhesion to mordant layers. Katoh, in U.S. Pat. No. 4,629,677, discloses stripping layers in diffusion transfer elements, wherein said layers comprise copolymers having more than 40 mole percent of a monomer unit derived from an ethylenically unsaturated carboxylic acid. Hayashi et al., in U.S. Pat. No. 4,728,595, disclose stripping layers in diffusion transfer elements formulated with light-reflective organic polymers.

Diffusible Dye Releasing Couplers

Dappen and Smith in U.S. Pat. No. 3,743,504 disclose the use of immobile diffusible-dye-forming couplers and immobile diffusible-dye-releasing couplers in a color diffusion transfer system.

Minagawa, Arai, and Ueda in U.S. Pat. 4,141,730 disclose the use of immobile colored coupling compounds which release diffusible dye during color development. These compounds are used to advantage in masking applications.

Lau, in U.S. Pat. 4,248,962, discloses dye releasing couplers wherein dyes are anchimerically released by coupling-off groups subsequent to reaction of oxidized aromatic amine developers with said couplers.

Sakanoue, Hirano, Adachi, Minami, and Kanagawa in German Offen. No. 3,324,533 A1, Booms and Holstead in U.S. Pat. No. 4,420,556, and Arakawa and Watanabe in European Pat. Specification 115,303 B1 disclose the use of diffusible dye forming couplers to provide photographic materials with improved graininess.

Mooberry and Singer, in U.S. Pat. 4,840,884, disclose dye-releasing couplers that release electrically neutral dyes and wherein said dyes are released from a coupling-off group comprising a dye and a divalent linking group of the formula -L-NR-, wherein L is a divalent linking group and NR is a substituted nitrogen atom.

Barrier Layers

Cardone, in U.S. Pat. No. 3,888,669, discloses the use of barrier layers in multilayer and multicolor composite diffusion transfer film units. Said diffusion transfer film units comprise diffusible dye forming layers, a dye fixing layer or a dye mordanting layer, an opaque layer or means for producing an opacifying layer, a barrier layer impermeable to the diffusible dyes produced but permeable to a contacting processing composition, a dimensionally stable transparent layer adjacent to the barrier layer, means for interposing between said barrier layer and said adjacent dimensionally stable transparent layer a processing composition, and means for maintaining the composite film unit intact subsequent to diffusion transfer processing of the unit.

The use of spacer layers or timing layers as barrier layers to delay the function of neutralizing layers in diffusion transfer processes is described in U.S. Pat. Nos. 2,584,030, 3,419,389, 3,421,893, 3,433,633, 3,455,686, 3,592,645, 3,756,815, and 3,765,893, and in Research Disclosure, Vol. 123, July 1974, Item No. 12331, entitled Neutralizing Materials in Photographic Elements. Specific polymeric materials which have been demonstrated to be effective as barrier layers between dye image forming units have been disclosed in U.S. Pat. Nos. 3,384,483, 3,345,163, and 3,625,685.

The use of barrier layers during development in image diffusion transfer elements, particularly integral elements, to prevent diffusion of materials to the image receiving layer has been described by Buckler et al. in U.S. Pat. No. 3,679,409. Such barrier layers allow diffusion of image forming materials or products of such materials at high pH, such as the pH of the processing composition, prevent diffusion of such materials at low pH, and thereby prevent diffusion of the image forming materials after processing. Other means for forming barrier layers are disclosed in U.S. Pat. Nos. 3,576,626 and 3,597,197.

Abel and Bowman, in U.S. Pat. No. 4,504,569, disclose a temporary barrier layer comprising N-alkyl substituted acrylamide and a polymerized crosslinking monomer wherein the polymer has a solubility parameter from 13 to 16 at 25° C. The barrier layer is useful as a process timing layer in color image transfer film units.

Bowman and Verhow, in U.S. Pat. No. 4,865,946, disclose a temporary barrier layer comprising polymerizable monomers of certain acrylamides, crosslinking groups, and other ethylenically unsaturated monomers. Said barrier layers are useful in color image transfer units.

Holmes and Campbell, in U.S. Pat. No. 4,055,429, disclose a polymeric barrier layer for scavanging diffusible dyes.

PROBLEM TO BE SOLVED BY THE INVENTION

Bleach-fix solutions commonly contain iron, ammonium, ethylenediaminetetraacetic acid, thiosulfate and, after use, silver. These components of "wet" silver halide processing are the source of much of the pollution from photo finishing processes.

Photographic elements containing image-transfer diffusible dyes, when processed in developer baths of the type normally encountered in the photofinishing trade, suffer from a high degree of dye washout. This washout represents a major inefficiency in dye utilization, since the dye which washes out into the developer solution or other processing solution is no longer available to provide a dye image in the photographic element. Furthermore, this washout results in severe seasoning of the developer baths and in the unwanted accumulation of precipitates in low pH stop and bleaching baths. Most color diffusion transfer systems require the physical separation of donor and receiver elements during or immediately following development of the color diffusion transfer image. This separation results in the accumulation of solid waste.

Heat image separation systems, comprising wet development and thermal dye diffusion transfer, achieve significant reductions in processing effluent, but require a separate thermal processing step and excessively lengthy thermal activation in order to obtain desired levels of transferred dye density.

These and other problems may be overcome by the practice of our invention.

SUMMARY OF THE INVENTION

It is an object of our invention to reduce the amount of waste processing solution effluents generated by the overall processing system while retaining the benefits of image quality and industry compatibility which are derived from wet development with conventional developing solutions.

An object of the present invention is to provide improved image dye retention in the photographic element and improved image dye hue in said element. Yet another object of the present invention is to minimize the seasoning of processing solutions with diffusible dyes. An additional object of the present invention is to minimize the amount of solid waste generated in the photofinishing of color print materials.

In accordance with this invention a photographic color diffusion transfer element is provided wherein said element comprises a single dimensionally stable support, wherein said support comprises an opaque and light reflecting layer, and coated thereon in reactive association and in sequence (1) a mordant layer for binding diffusible dyes, (2) a stripping layer, (3) one or more layers comprising radiation sensitive silver halide and a diffusible-dye forming coupler, and (4) a barrier layer comprising a polymer that (a) allows the passage of solutions for processing said element when said element is contacted with an external processing bath and (b) impedes the diffusion out of said element of the diffusible dye formed from said diffusible-dye forming coupler, and wherein said diffusible-dye forming coupler is of the structure Cp-L-Dye wherein Cp is a coupler radical selected from the group comprising cyan dye forming radicals, magenta dye forming radicals, yellow dye forming radicals, black dye forming radicals, and colorless product forming radicals, said Cp being substituted in the coupling position with a divalent linking group, L;

Dye is a dye radical exhibiting selective absorption in the visible spectrum and contains a solubilizing group;

and where said -L-Dye group couples off upon reaction of said coupler radical with the oxidation product of a primary amine developing agent. In another preferred embodiment, said element comprises a single dimensionally stable transparent support, and coated thereon in reactive association and in sequence (1) a mordant layer for binding diffusible dyes, (2) an opacifying light reflecting layer, (3) one or more layers comprising radiation sensitive silver halide and a diffusible-dye forming coupler, and (4) a barrier layer comprising a polymer that (a) allows the passage of solutions for processing said element when said element is contacted with an external processing bath and (b) impedes the diffusion out of said element of the diffusible dye formed from said diffusible-dye forming coupler. In another preferred embodiment, said element comprises a single dimensionally stable transparent support, and coated thereon in reactive association and in sequence (1) one or more layers comprising radiation sensitive silver halide and a diffusible-dye forming coupler, (2) an opacifying light reflecting layer, (3) a mordant layer for binding diffusible dyes, and (4) a barrier layer comprising a polymer that (a) allows the passage of solutions for processing said element when said element is contacted with an external processing bath and (b) impedes the diffusion out of said element of the diffusible dye formed from said diffusible-dye forming coupler.

ADVANTAGEOUS EFFECT OF THE INVENTION

The present invention reduces the amount of waste processing solution effluent generated by the overall processing system while retaining the benefits of image quality and industry compatibility derived from wet development with conventional developing solutions. The invention also provides impored image dye retention in the photographic elements and minimizes the seasoning of processing solutions with diffusible dyes. The invention also minimizes the amount of solid waste generated in the photofinishing of color print materials.

DETAILED DESCRIPTION OF THE INVENTION

The term "nondiffusing" used herein as applied to the couplers and diffusible-dye forming compounds has the meaning commonly applied to the term in color photography and denotes materials which for all practical purposes do not migrate or wander through organic colloid layers, such as gelatin, comprising the sensitive elements of the invention. The term "diffusible" as applied to dyes formed from these "nondiffusing" couplers and compounds in the processes has the converse meaning and denotes materials having the property of diffusing effectively through the colloid layers of the sensitive elements in the presence of the "nondiffusing" materials from which they are derived.

The term "barrier" used herein as applied to "barrier layers" has the meaning commonly applied to the term in color photography and denotes an impediment to the aqueous diffusion of diffusible-dyes.

Film Structures and Multilayer Formats

Important to this invention is the arrangement of various generic layers in the integral diffusion transfer element. The basic layers may be described as (1) a support, (2) a mordanting layer for fixing diffusible dye, (3) an imaging layer comprising radiation sensitive material and diffusible dye forming compounds, and (4) a barrier layer for impeding the diffusion of diffusible dye while said element is in contact with an external developing bath. Said radiation sensitive material is preferably silver halide. Any of these basic layers may comprise one or more actual layers.

In a preferred embodiment illustrated in Table 1, Layer Strucuture 1, these generic layers are arranged in the above listed sequence, and a stripping layer is incorporated between said mordanting and imaging layers. In the preferred Layer Structure 1 the light sensitive imaging layer is exposed through the barrier layer, and said structure is developed by contacting said barrier layer with a large volume development bath. After development, a stop bath and/or a wash bath are applied by contacting with said barrier layer, and the element is subsequently stripped to separate the dye diffusion transfer image, found in the dye fixing or mordant layer from the radiation-sensitive material-image in the imaging layer.

TABLE 1

| Layer Structure 1 |
|---|
| Barrier Layer |
| Diffusible-Dye Releasing (Imaging) Layer |
| Stripping Layer |
| Mordant (Dye Fixing) Layer |
| Reflection Base (Support) |

In another preferred embodiment, the above layers are arranged in the sequence: (1) a transparent support; (2) a mordanting layer for fixing diffusible dye; (3) an imaging layer comprising radiation sensitive material and diffusible dye forming compounds; and (4) a barrier layer for impeding the diffusion of diffusible dye while said element is in contact with an external developing bath. Said embodiment further comprises an opacifying reflection layer placed between said mordanting and imaging layers, wherein said reflection layer is permeable to said diffusible dye. Any of these illustrated layers may have additional interlayers of any type adjacent to said illustrated layers. Such additional interlayers may comprise oxidized developer scavengers, matting agents, gelatin, silver halide, colloidal silver, highly scattering pigments, filter dyes of any type, UV absorbing dyes of any type, etc. The diffusible-dye releasing imaging layer may comprise two or several layers, wherein light sensitive material such as silver halide and diffusible-dye releasing couplers are in separate layers. In the preferred Layer Structure 2 the light sensitive imaging layer is exposed through the barrier layer, and said structure is developed by contacting said barrier layer with a large volume development bath. After development, a stop bath and/or a wash bath is/are applied by contacting with said barrier layer. The final image in the mordant layer is viewed through the transparent support.

TABLE 2

| Layer Structure 2 |
|---|
| Barrier Layer |
| Diffusible-Dye Releasing (Imaging) Layer |
| Opacifying Reflection Layer |
| Mordant (Dye Fixing) Layer |
| Transparent Base (Support) |

In another preferred embodiment, the above layers are arranged in the sequence: (1) a transparent support; (3) an imaging layer comprising radiation sensitive material and diffusible-dye forming compounds; (2) a mordanting layer for fixing diffusible dye; and (4) a barrier layer for impeding the diffusion of diffusible dye while said element is in contact with an external developing bath. Said embodiment further comprises an opacifying reflection layer placed between said mordanting and imaging layers, wherein said reflection layer is permeable to said diffusible dye. Any of these illustrated layers may have additional interlayers of any type adjacent to said illustrated layers. Such additional interlayers may comprise oxidized developer scavengers, matting agents, gelatin, silver halide, colloidal silver, highly scattering pigments, filter dyes of any type, UV absorbing dyes of any type, etc. The diffusible-dye releasing imaging layer may comprise two or more layers, wherein light sensitive material such as silver halide and diffusible-dye releasing couplers are in separate layers. In the preferred Layer Structure 3 the light sensitive imaging layer is exposed through the transparent support. Said structure is developed by contacting said barrier layer with a large volume development bath. After development, a stop bath and/or a wash bath is/are applied by contacting with said barrier layer. The final image in the mordant layer is viewed through the transparent support.

TABLE 3

| Layer Structure 3 |
|---|
| Barrier Layer |
| Mordant (Dye Fixing) Layer |
| Opacifying Reflection Layer |
| Diffusible-Dye Releasing (Imaging) Layer |
| Transparent Base (Support) |

Many embodiments may be constructed, with variations in layer structure and composition, which fall within the spirit and scope of the present invention, so long as said embodiments comprise the above listed basic layers and further do so such that said barrier layer is situated so as to impede the diffusion of diffusible dyes into an external developing bath.

Mordant Layers

Mordant layers are formulated as combinations of hydrophilic colloidal binder and mordants. Particularly effective mordants comprise polymers that have high binding affinity for diffusible dyes. Suitable hydrophilic colloidal binders include gelatin, gelatin derivatives, polyvinyl alcohol, cellulose derivatives, polysaccharides such as starches and gum arabic, synthetic substances such as water soluble polyvinyl compounds, synthetic substances such as dextrin, pululan, polyvinyl pyrrolidone and acrylamides. Gelatin is a preferred hydrophilic colloidal binder because of its low cost and ease of use in photographic elements and processes. Mordant layers are dye fixing layers. It is known to incorporate UV stabilizers in such dye fixing layers. Such incorporation of UV stabilizers in dye fixing layers has the advantage of achieving UV stabilization without the added cost of coating a separate UV filter layer. It is also known to separate such layers into two sublayers, where one of said sublayers comprises mordant polymer and the other of said sublayers comprises a UV stabilizer. This approach, while suffering the added cost of coating an extra layer, has the advantage of providing superior UV protection and stabilization to the dye image.

Mordant polymers that contain a vinyl monomer unit having a tertiary amino group or a quaternary ammonium group are preferred because of their ease of synthesis by radical polymerization and because of the binding affinity for diffusible dyes such groups provide. Such preferred mordant polymers have been described by Aono et al. in U.S. Pat. No. 4,636,455 incorporated herein by reference. Said mordant polymers comprise vinyl monomer units selected from the group consisting of:

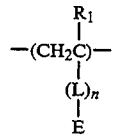

mo-i wherein $R_1$ is a hydrogen atom or a lower alkyl group having 1 to 6 carbon atoms; L represents a divalent linking group having 1 to 20 carbon atoms; E represents a hetero ring containing a carbon-nitrogen double bond; and n is 0 or 1;

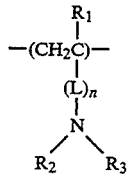

mo-ii wherein $R_1$, L, and n have the same meaning as in formula mo-i; $R_2$ and $R_3$ are the same or different and each represents an alkyl group having 1 to 12 carbon atoms or an aralkyl group having 7 to 20 carbon atoms, and $R_2$ and $R_3$ may form, together with the adjacent nitrogen atom, a cyclic structure;

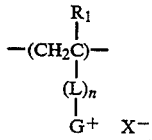

mo-iii wherein $R_1$, L, and n have the same meaning as in formula mo-i; $G^+$ represents a hetero ring which is quaternized and contains a carbon-nitrogen double bond; and $X^-$ represents a monovalent anion; and

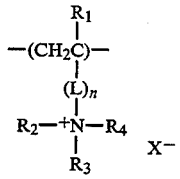

mo-iv wherein $R_1$, L, and n have the same meaning as in formula mo-i; $R_2$ and $R_3$ have the same meaning as in formula mo-ii; $R_4$ has the same definition as $R_2$ and R3; $X^-$ has the same meaning as in formula mo-iii, and $R_2$ and $R_3$, $R_3$ and $R_4$, or $R_2$ and $R_4$ may form, together with the adjacent nitrogen atom, a cyclic structure.

Mordant polymers as described by Klein et al., in U.S. Pat. No. 4,450,224, incorporated herein in its entirety by reference, and comprising vinyl imidazolium, vinyl imidazole, acrylonitrile, methacrylonitrile, and $\alpha,\beta$-ethylenically unsaturated monomers are preferred for formulating mordant layers because of their effectiveness in binding diffusible dyes.

Copolymers of imidazole containing monomers and sulfinic acid containing monomers are suitable mordant polymers. Such mordant polymers have been described by Nakamura et al. in U.S. Pat. No. 4,594,308, the disclosure of which is incorporated herein by reference. Other suitable mordant polymers comprising imidazole containing repeat units have been disclosed by Shibata and Hirano in U.S. Pat. No. 4,774,162, the disclosure of which is incorporated herein in its entirety. Preferred mordant polymers are depicted in Table 6, wherein the repeating-unit subscripts indicate weight percents of the repective repeating units and wherein the chloride anion may be replaced with any monovalent anion.

The mixture of colloidal binder (preferably gelatin) and mordant polymer and the amount coated in the formulation of the mordant layer may be any suitable amount and will vary according to the particulars of the element and use, such as the particular polymeric mordant used and the particular development process used. The ratio of mordant polymer to binder is preferably in the range of 1:5 to 5:1 (weight ratio) because suitble compliance and ductility of said mordant layer is thereby maintained, and the amount of mordant polymer coated is preferably in the range of 0.2–15 g/m$^2$, more preferably in the range of 0.5–8 g/m$^2$ in order to obtain suitable dye binding while not providing an excessively think mordant layer. The molecular weight of the polymer mordant used is preferably in the range of 1,000–1,000,000, and more preferably in the range of about 10,000–200,000, so as to obtain coating solutions and suspensions in the coating of mordant layers, wherein said solutions and suspensions have suitable viscosities for high speed coating operations encountered in the manufacture of photographic elements.

Stripping Layers

Stripping layers are included in preferred embodiments to facilitate the mechanical separation of receiver layers and mordant layers from donor layers and diffusible dye forming layers. Stripping layers are usually coated between a mordant containing layer or dye receiving layer and one or more diffusible dye forming layers. Stripping layers may be formulated essentially with any material that is easily coatable, that will allow processing chemistry and solutions to pass therethrough, that will maintain dimensional inegrity for a sufficient length of time so that a suitable image may be transferred by dye diffusion therethrough with sufficiently adequate density and sharpness, and that will facilitate the separation of donor and receiver components of the photographic element under wet or dry stripping conditions. Said dimensional stability must be maintained during storage and at least partway through the development and dye forming process. In preferred embodiments this dimensional stability is maintained during all wet processing steps and during subsequent drying. Various stripping polymers and stripping agents may be used alone and in combination in order to achieve the desired strippability in particular processes with particular photographic elements. The desired strippability in a given process is that which results in clean separation between the image receiving layer and the emulsion and diffusible dye forming layers adhering to the image receiving layer. Good results have in general been obtained with stripping agents coated at level of 3 mg/m$^2$ to about 500 mg/m$^2$. The particular amount to be employed will vary, of course, depending on the particular stripping agent employed and the particular photographic element used, and the particular process employed.

Perfluorinated stripping agents have been disclosed by Bishop et al. in U.S. Pat. No. 4,459,346, the disclosure of which is incorporated herein in its entirety by reference. In a preferred embodiment of our invention, the stripping layer comprises stripping agents of the following formula:

$$CF_3(CF_2)_n-SO_2-\overset{\overset{R_1}{|}}{N}-CH_2R_2$$

wherein $R_1$ is an alkyl or substituted alkyl group having from 1 to about 6 carbon atoms or an aryl or substituted aryl group having from about 6 to about 10 carbon atoms; $R_2$ is $$-\overset{\overset{O}{\|}}{C}-O-(CH_2CH_2O)_x-R_3,$$

$$-\overset{\overset{O}{\|}}{C}-O-(CH_2)_y-R_3, \text{ or}$$

$$-CH_2-O-(CH_2CH_2O)_z-R_3;$$

$R_3$ is H or $R_1$; n is an integer of from about 4 to about 19; x and y each represents an integer from about 2 to about 50, and z each represents an integer of from 1 to about 50, because such a stripping layer has weak dry adhesion. In another preferred embodiment, $R_1$ is ethyl, $R_2$ is $$-\overset{\overset{O}{\|}}{C}-O-(CH_2CH_2O)_x-H,$$

n is about 8, and x is about 25 to 50. In another embodiment preferred because of weak dry adhesion provided by the stripping layer, $R_1$ is ethyl, $R_2$ is $$-\overset{\overset{O}{\|}}{C}-O-(CH_2)_y-H,$$

n is about 8, and y is about 25 to 50. In another preferred embodiment, $R_1$ is ethyl, $R_2$ is $-CH_2O(CH_2CH_2O)_zH$, n is 8 and z is 1 to about 30.

If the process of this invention is used to produce a transparency element for use in high magnification projection, it is desirable to maintain sharpness and to minimize the distance of dye diffusion. This minimization is achieved in part by using a stripping layer that does not swell appreciably and which is as thin as possible. These requirements are met by the perfluoronated stripping agents herein described. These stripping agents provide clean stripping and do not materially alter the surface properties at the stripping interface. The above perfluoronated stripping agents provide for a stripping layer with weak dry adhesion and are preferred for dry stripping. A strong dry adhesion makes separation of substantially dry elements difficult.

Preferred dry stripping agents useful in the process of this invention include the compounds listed in Table 4.

Wet stripping is facilitated by stripping polymers that are soluble in processing solution, or become soft in such a solution. Suitable polymers for wet stripping include gum arabic, sodium alginate, pectin, cellulose acetate hydrogen phthalate, polyvinyl alcohol, hydroxyethyl cellulose, agarose, polymethacrylic acid, plasticized methyl cellulose, ethyl cellulose, methyl methacrylate, butyl methacrylate, and polyethylene oxide. The dislcosures of Land (in U.S. Pat. No. 3,220,835) and of Dannhauser (in U.S. Pat. No. 3,730,718) describe stripping layer formulations suitable for the present invention and are incorporated herein in their entirety by reference. Also suitable for the present invention are stripping layers formulated with polyaddition products of bisacrylamides and diamines, as disclosed by Tsuji et al. (in U.S. Pat. No. 3,820,999), the disclosure of which is incorporated herein by reference. Preferred wet stripping polymers are listed in Table 5; these polymers provide weak wet adhesion.

TABLE 4

| Stripping Agents | |
|---|---|
| $C_8F_{17}SO_2-N(CH_2CH_3)-CH_2-C(=O)-O-(CH_2CH_2O)_{40}-H$ (Fluorad ® FC-431 [3M Company]) | SA1 |
| $C_8F_{17}SO_2-N(CH_2CH_3)-CH_2-C(=O)-O-(CH_2)_{40}-H$ (Fluorad ® FC-432 [3M Company]) | SA2 |
| $C_8F_{17}SO_2-N(CH_2CH_3)-(CH_2CH_2O)_{\overline{2-30}}-H$ (Fluorad ® FC-170 [3M Company]) | SA3 |

TABLE 5

| Stripping Polymers | |
|---|---|
| $-(CH_2CH)_x-(CH_2C(CH_3))_y-(CH_2C(CH_3))_z-$ with $C(=O)N(CH_3)_2$, $C(=O)O(CH_2)_3CH_3$, $C(=O)OCH_2CH_2O-C(=O)-(CCH_2)(CH_3)-$ (where x = 30–70; y = 20–60; z = 0–20 mol percent) | SP1 |
| $-(CH_2CH)_x-(CH_2CH)_y-$ with $C(=O)OCH_3$, $C(=O)(OCH_2CH_2)_n-C_{13}H_{27}$-sec (where x = 20–80; y = 20–80 mol percent) | SP2 |

Diffusible Dye-Releasing Couplers

Diffusible-dye releasing compounds of any type may be utilized, so long as said diffusible dyes are diffusible in an aqueous colloid such as gelatin and related hydrophilic colloids. Said diffusible dyes preferably contain solubilizing groups. Preferred are compounds according to formula I Cp-L-Dye (I)

wherein Cp is a coupler radical, L is a divalent linking group, and Dye is a dye radical exhibiting selective absorption in the visible spectrum and contains a solubilizing group.

Coupling Radicals

Cp may represent a coupler radical, capable of forming a cyan dye by coupling with an aromatic primary amine developing agent. Couplers which form cyan dyes upon reaction with oxidized color developing agents are described in such representative patents as U.S. Pat. Nos. 2,367,531, 2,423,730, 2,474,293, 2,772,162, 2,801,171, 2,895,826, 3,002,836, 3,034,892, 3,041,236, 3,419,390, 3,476,565, 3,779,763, 3,996,252, 4,124,396, 4,248,962, 4,254,212, 4,296,200, 4,333,999, 4,443,536, 4,457,559, 4,500,635, 4,526,864, and 4,874,689 and in European Patent Application No. 0 283 938 A1, the disclosures of which are incorporated by reference. Preferred coupler radicals Cp which form cyan dyes upon reaction with oxidized color developing agents are of the phenol type (formula C-I) or the naphthol type (formulae C-II and C-III) or of the type C-IV; the asterisk mark indicates the position of the bond to the divalent linking group L in formula (I); these radicals are preferred because of their ease of manufacture and because of their excellent reactivity with oxidized color developers.

C-I

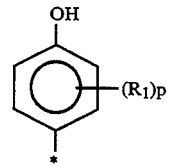

C-II

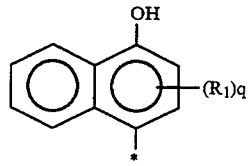

C-III

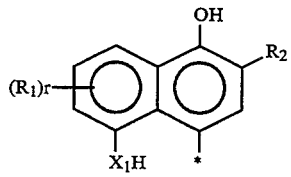

C-IV

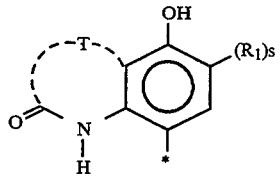

In formulae C-I, C-II, C-III, and C-IV above:

$R_1$ has 0 to 30 carbon atoms and represents a possible substituent on the phenol ring or naphthol ring. It is an alkyl group, an alkenyl group, an alkoxy group, an alkoxycarbonyl group, a halogen atom, an alkoxycarbamoyl group, an aliphatic amido group, an alkylsulfamoyl group, an alkylsulfonamido group, an alkylureido group, an arylcarbamoyl group, an arylamido group, an arylsulfamoyl group, an arylsulfonamido group, an arylureido group, hydroxyl group, amino group, carboxyl group, sulfo group, heterocylcic group, carbonamido group, sulfonamido group, carbamoyl group, sulfamoyl group, ureido group, acyloxy group, aliphatic oxy group, aliphatic thio group, aliphatic sulfonyl group, aromatic oxy group, aromatic thio group, aromatic sulfonyl group, sulfamoyl amino group, nitro group, or imido group.

$R_2$ represents $—CONR_3R_4$, $—NHCOR_3$, $—NHCOOR_5$, $NHSO_2R_5$, $—NHCONR_3R_4$, or $NHSO_2R_3R_4$, $R_3$ and $R_4$ each represent a hydrogen atom, aliphatic group having 1 to 30 carbon atoms (such as methyl, ethyl, butyl, methoxyethyl, n-decyl, n-dodecyl, n-hexadecyl, trifluoromethyl, heptafluoropropyl, dodecyloxypropyl, 2,4-di-t-amylphenoxy-propyl, and 2,4-di-t-amylphenoxybutyl), aromatic group having from 6 to 30 carbon atoms (such as phenyl, tolyl, 2-tetradecyloxyphenyl, pentafluorophenyl, and 2-chloro-5-dodecyloxycarbonylphenyl), or heterocyclic group having from 2 to 30 carbon atoms (such as 2-pyridyl, 4-pyridyl, 2-furyl, and 2-thienyl). $R_5$ represents an aliphatic goup having from 1 to 30 carbon atoms (such as methyl, ethyl, butyl, methoxyethyl, n-decyl, n-dodecyl, and n-hexadecyl), aromatic goup having from 6 to 30 carbon atoms (such as phenyl, tolyl, 4-chlorophenyl, and naphthyl), or heterocyclic group (such as 2-pyridyl, 4-pyridyl, and 2-furyl). $R_3$ and $R_4$ may join each other to form a heterocyclic ring (such as morpholine ring, piperidine ring, and pyrrolidine ring); p is an integer form 0 to 3; q and r are integers from 0 to 4; s is an integer from 0 to 2.

$X_1$ represents an oxygen atom, sulfur atom, or $R_6N<$ group, where $R_6$ represents a hydrogen atom or monovalent group. When $R_6$ represents a monovalent group, it includes, for example, an aliphatic group having from 1 to 30 carbon atoms (such as methyl, ethyl, butyl, methoxyethyl, and benzyl), aromatic group having from 6 to 30 carbon atoms (such as phenyl and tolyl), heterocyclic group having from 2 to 30 carbon atoms (such as 2-pyridyl and 2-pyrimidyl), carbonamido group having from 1 to 30 carbon atoms (such as formamido, acetamido, N-methylacetamido, toluenesulfonamido, and 4-chlorobenzenesulfonamido), imido group having from 4 to 30 carbon atoms (such as succinimido), $—OR_7$, $—SR_7$, $—COR_7$. $—CONR_7R_8$, $—COCOR_7$, $—COCOR_7R_8$, $—COOR_7$, $—COCOOR_9$, $—SO_2R_9$, $—SO_2OR_9$, $—SO_2NR_7R_8$, or $—NR_7R_8$. $R_7$ and $R_8$, which may be the same or different, each represent a hydrogen atom, aliphatic group having from 1 to 30 carbon atoms (such as methyl, ethyl, butyl, methoxyethyl, n-decyl, n-dodecyl, n-hexadecyl, trifluoromethyl, heptafluoropropyl, dodecyloxypropyl, 2,4-di-t-amylphenoxypropyl, and 2,4-di-t-amylphenoxybutyl), aromatic group having from 6 to 30 carbon atoms (such as phenyl, tolyl, 2-tetradecyloxyphenyl, pentafluorophenyl, and 2-chloro-5-dodecyloxycarbonylphenyl), or heterocyclic group having from 2 to 30 carbon atoms (such as 2-pyridyl, 4-pyridyl, 2-furyl, and 2-thienyl). $R_7$ and $R_8$ may join each other to form a heterocyclic ring (such as morpholine group and piperidino group). $R_9$ may include, for example, those substituents (excluding a hydrogen atom) exemplified for $R_7$ and $R_8$.

T represents a group of atoms required to form a 5-, 6-, or 7-membered ring by connecting with the carbon atoms. It represents, for example $$—O—,\ —\underset{R'}{\underset{|}{N}}—,\ —\underset{O}{\underset{\|}{C}}—,\ —S—,\ —N=,\ =N—,\ —\underset{R'}{\underset{|}{C}}=,$$

-continued $$=\underset{R'}{\underset{|}{C}}—,\ \text{or}\ —\overset{R'}{\overset{|}{\underset{R''}{\underset{|}{C}}}}—,$$

or a combination thereof. In the formulae above, R′ and R″ each represent a hydrogen atom, alkyl group, aryl group, halogen atom, alkyloxy group, alkyloxycarbonyl group, arylcarbonyl group, alkylcarbamoyl group, arylcarbamoyl group or cyano group.

The preferred substituent groups in the present invention are exemplified in the following:

$R_1$ includes a halogen atom (such as fluorine, chlorine, and bromine), aliphatic group (such as methyl, ethyl, and isopropyl), carbonamido group (such as acetamido and benzamido), and sulfonamido (such as methanesulfonamido and toluenesulfonamido).

$R_2$ includes $—CONR_3R_4$ (such as carbamoyl, ethylcarbamoyl, morpholinocarbonyl, dodecylcarbamoyl, hexadecylcarbamoyl, decyloxypropyl, dodecyloxypropyl, 2,4-di-tert-amylphenoxypropyl, and 2,4-di-t-amylphenoxybutyl). $X_1$ includes $R_6N<$, wherein $R_6$ is preferably $—COR_7$ (such as formyl, acetyl, trifluoroacetyl, benzoyl, pentafluorobenzoyl, and p-chlorobenzoyl), $—COOR_9$ (such as methoxycarbonyl, ethoxycarbonyl, butoxycarbonyl, dodecyloxycarbonyl, methoxyethoxycarbonyl, and phenoxycarbonyl),$—SO_2R_9$ (such as methanesulfonyl, ethanesulfonyl, butanesulfonyl, hexadecanesulfonyl, benzenesulfonyl, toluenesulfonyl, and p-chlorobenzensulfonyl), $—CONR_7R_8$ (such as N,N-dimethyl carbamoyl, N,N-diethylcarbamoyl, N,N-dimethylcarbamoyl, N,N-diethylcarbamoyl, N,N-dibutylcarbamoyl, morpholinocarbonyl, piperidinocarbonyl, 4-cyanophenylcarbamoyl, 3,4-dichlorophenylcarbamoyl, and 4-methanesulfonylphenylcarbamoyl, and N,N-dibutylcarbamoyl), and $—SO_2NR_7R_8$ (such as N,N-dimethylsulfamoyl, N,N-diethylsulfamoyl, and N,N-dipropylsulfamoyl). Particularly preferred examples of $R_6$ are those groups represented by $—COR_7$, $—COOR_9$, and $—SO_2R_9$.

$R_1$ may be substituted. Preferred substituents are aryl groups (such as phenyl), nitro group, hydroxy group, cyano group, sulfo group, an alkoxy group (such as methoxy), an aryloxy group (such as phenoxy), an acyloxy group (such as acetoxy), an acylamino group (such as aetylamino), an alkylsufonamido group (such as methanesulfonamido), an alkylsulfamoyl group (such as fluorine atom, chlorine atom, bromine atom), carboxyl group, an alkylcarbamoyl group (such as methylcarbamoyl), an alkoxycarbonyl group (such as methoxycarbonyl), an alkylsulfonyl group (such as methylsulfonyl), an alkylthio group (such as β-carboxyethylthio), etc. In the case that said group is substituted by two or more of said substituents, these substituents may be the same or different.

Cp may represent a coupler radical, capable of forming a magenta dye by coupling with an aromatic primary amine developing agent. Couplers which form magenta dyes upon reaction with oxidized color developing agents are described in such representative patents and publications as U.S. Pat. Nos. 1,969,479, 2,311,082, 2,343,703, 2,369,489, 2,600,788, 2,908,573, 3,061,432, 3,062,653, 3,152,896, 3,519,429, 3,615,506, 3,725,067, 4,120,723, 4,500,630, 4,522,916, 4,540,654, 4,581,326, and 4,874,689, and European Patent Publication Nos. 0 170 164, 0 177 765, 0 283 938 A1, and 0 316 955 A3, the disclosures of which are incorporated by reference. Preferred magenta couplers include pyrazolones, pyrazolotriazole, and pyrazolobenzimidazole compounds which can form heat transferable dyes upon reaction with oxidized color developing agent. Preferred coupler radicals Cp which form magenta dyes upon reaction with oxidized color developing agents are of the pyrazolotriazole-type and imidazopyrazole-type (formulae M-I to M-VII); the asterisk mark indicates the position of the bond to the divalent linking group L in formula (I); these radicals are preferred because of their ease of manufacture and because of their excellent reactivity with oxidized color developers.

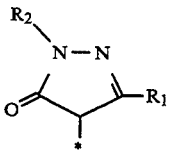

M-I

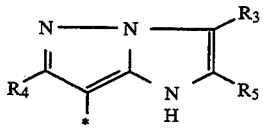

M-II

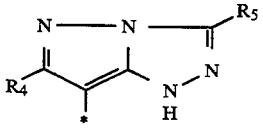

M-III

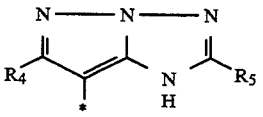

M-IV

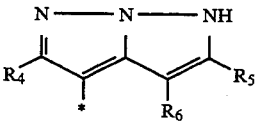

M-V

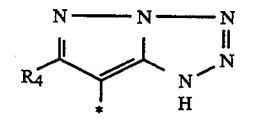

M-VI

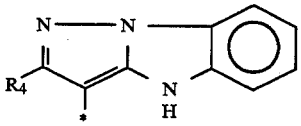

M-VII

In formulae M-I, M-II, M-III, M-IV, M-V, M-VI, and M-VII above:

$R_1$ and $R_2$ each independently represent a conventional substituent which is well known as a substituent on the 1-position or on the 3-position of a 2-pyrazolin-5-one coupler, such as an alkyl group, a substituted alkyl group (such as a halo-alkyl group, e.g., fluoroalkyl, or cyano-alkyl, or benzyl-alkyl), an aryl group or a substituted arylgroup (e.g., methyl or ethyl substituted), an alkoxy group (such as methoxy or ethoxy), an aryloxy group (such as phenyloxy), an alkoxycarbonyl group (such as methoxy carbonyl), an acylamino group (such as acetylamino), a carbamoyl group, an alkylcarbamoyl group (such as methylcarbamoyl or ethylcarbamoyl), a dialkylcarbamoyl group (such as dimethylcarbamoyl), an arylcarbamoyl group (such as phenylcarbamoyl), an alkylsulfonyl group (such as methylsulfonyl), an arylsufonyl group (such as phenylsulfonyl), an alkylsulfonamido group (such as methanesulfonamido), an arylsulfonamido group (such as phenylsulfonamido), a sulfamoyl group, an alkylsulfamoyl group (such as ethylsulfamoyl), a dialkylsulfamoyl group (such as dimethylsulfamoyl), an arylsulfamoyl group, an alkylthio group (such as methylthio), an arylthio group (such as phenylthio), cyano group, nitro group, a halogen atom (such as fluorine atom, chlorine atom, bromine atom), etc. In case said group is substituted by two or more of said substituents, these may be the same or different. The most preferred substituents are a halogen atom, an alkyl group, an alkoxy group, an alkoxycarbonyl group, and the cyano group.

$R_3$, $R_4$, $R_5$, and $R_6$ are each independently a hydrogen atom or hydroxyl group, or represent an unsubstituted or substituted alkyl group (preferably having from 1 to 20 carbon atoms, such as methyl, propyl, t-butyl, or trifluoromethyl, tridecyl), an aryl group (preferably having from 6 to 20 carbon atoms, such as phenyl, 4-t-butylphenyl, 2,4-di-t-amylphenyl, or 4-methoxyphenyl), a heterocyclic group (such as 2-furyl, 2-thienyl, 2-pyrimidinyl, or 2-benzthiazolyl), an alkylamino group (preferably having from 1 to 20 carbon atoms, such as methylamino, diethylamino, t-butylamino), an acylamino group (preferably having from 2 to 20 carbon atoms, such as acetylamino, propylamido, benzamido), an anilino group (such as phenylamino, 2-chloroanilino), an alkoxycarbonyl group (preferably having from 2 to 20 carbon atoms, such as methoxycarbonyl, butoxycarbonyl, 2-ethylhexyloxycarbonyl), an alkylcarbonyl group (preferably having from 2 to 20 carbon atoms, such as acetyl, butylcarbonyl, cyclohexylcarbonyl), an arylcarbonyl group (preferably having from 7 to 20 carbon atoms, such as benzoyl, or 4-t-butylbenzoyl), an alkylthio group (preferably having from 1 to 20 carbon atoms, such as methylthio, octylthio, 2-phenoxyethylthio), an arylthio group (preferably having from 6 to 20 carbon atoms, such as phenylthio, 2-butoxy-5-t-octylphenylthio), a carbamoyl group (preferably having from 1 to 20 carbon atoms, such as N-ethylcarbamoyl, N,N-dibutylcarbamoyl, N-methyl-N-butylcarbamoyl), a sulfamoyl group (preferably $NH_2SO_2$ and a group having from 1 to 20 carbon atoms, such as N-ethylsulfamoyl, N,N-diethylsulfamoyl, N,N-dipropylsulfamoyl), or an alkyl sulfonamido group (preferably having from 6 to 20 carbon atoms, such as benzenesulfonamido, p-toluenesulfonamido).

Cp may represent a coupler radical, capable of forming a yellow dye by coupling with an aromatic primary amine developing agent. Couplers which form yellow dyes upon reaction with oxidized color developing agent are described in such representative U.S. Pat. Nos. as 2,298,443, 2,875,057, 2,407,210, 3,265,506, 3,384,657, 3,408,194, 3,415,652, 3,447,928, 3,542,840, 4,046,575, 3,894,875, 4,095,983, 4,182,630, 4,203,768, 4,221,860, 4,326,024, 4,401,752, 4,443,536, 4,529,691, 4,587,205, 4,587,207 and 4,617,256, and in European Patent Applications 0 259 864 A2, 0 283 938 A1, and 0 316 955 A3, the disclosures of which are incorporated by reference. Preferred yellow dye image forming couplers are acylacetamides, such as benzoylacetanilides and pivalylacetanilides, which can form heat transferable dyes upon reaction with oxidized color developing agent. Preferred coupler radicals Cp which form yellow dyes upon reaction with oxidized color developing agents are of the acylacetanilide type (formula Y-I) and benzoylacetanilide type (formulae Y-II and Y-III); the asterisk mark indicates the position of the bond to the divalent linking group L in formula (I); these radicals are preferred because of their ease of manufacture and because of their excellent reactivity with oxidized color developers.

Y-I

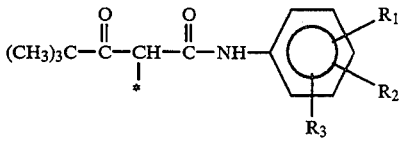

Y-II

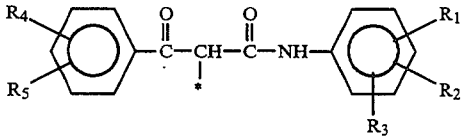

Y-III

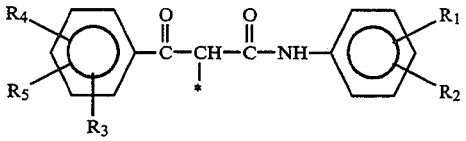

In formulae Y-I, Y-II, and Y-III above:

$R_1$, $R_2$, $R_3$, $R_4$, and $R_5$ each independently represents a hydrogen atom or a substituent which is conventional and well known in a yellow coupler group, for example, an alkyl group, an alkenyl group, an alkoxy group, an alkoxycarbonyl group, a halogen atom, an alkoxycarbamoyl group, an aliphatic amido group, an alkylsulfamoyl group, an alkylsulfonamido group, an alkylureido group, an alkyl-substituted succinimido group, an aryloxy group, an aryloxycarbonyl group, an arylcarbamoyl group, an arylamido group, an arylsulfamoyl group, an arylsulfonamido group, an arylureido group, carboxyl group, sulfo group, nitro group, cyano group, or thiocyano group.

Cp may represent a coupler radical, capable of forming a colorless product by coupling with an aromatic primary amine developing agent. Couplers which form colorless products upon reaction with oxidized color developing agent are described in such representative U.S. Pat. Nos. as 3,632,345, 3,928,041, 3,958,993, and 3,961,959, and in United Kingdom Pat. No. 861,138, the disclosures of which are incorporated herein by reference. Preferred colorless product forming couplers are cyclic carbonyl containing compounds and have the coupling-off group attached to the carbon atom in the $\alpha$ position with respect to the carbonyl group. Preferred coupling moieties Cp which form colorless products upon reaction with oxidized color developing agents are depicted in formulae W-I–W-IV; the asterisk mark indicates the position of the bond to the divalent linking group L in formula (I); these radicals are preferred because of their ease of manufacture and because of their excellent reactivity with oxidized color developers.

W-I

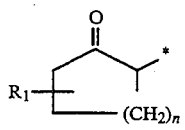

W-II

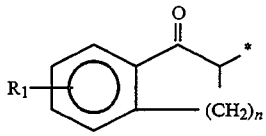

W-III

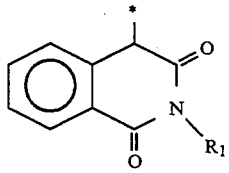

W-IV

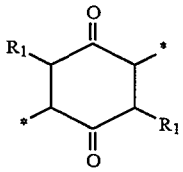

In formulae W-I–W-IV above: $R_1$ represents a ballast group; n is 1 or 2.

Cp may represent a coupler radical, capable of forming a black dye or a brown dye by coupling with an aromatic primary amine developing agent. Couplers which form black and brown dyes upon reaction with oxidized color developing agent are described in such representative U.S. Pat. Nos. as 1,939,231, 2,181,944, and 2,333,106, and 4126,461, and German OLS Nos. 2,644,194 and 2,650,764, which are incorporated herein by reference. Preferred black and brown dye forming couplers are resorcinols or m-aminophenols and have the coupling-off group attached in the para position with respect to the hydroxyl group Preferred coupling moieties Cp which form black dyes and brown dyes upon reaction with oxidized color developing agents are depicted in formulae B-I–B-III; the asterisk mark indicates the position of the bond to the divalent linking group L in formula (I); these radicals are preferred because of their ease of manufacture and because of their excellent reactivity with oxidized color developers.

B-I

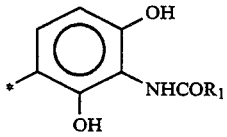

-continued

B-II

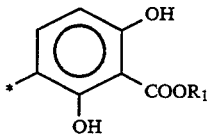

B-III

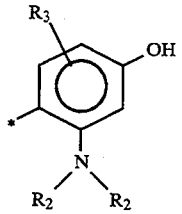

In formulae B-I–B-III above: $R_1$ is alkyl of 3 to 20 carbon atoms, phenyl, or phenyl substituted with hydroxy, halo, amino, alkyl of 1 to 20 carbon atoms or alkoxy of 1 to 20 carbon atoms; each $R_2$ is independently hydrogen, halogen, alkyl of 1 to 20 carbon atoms, alkenyl of 1 to 20 carbon atoms, or aryl of 6 to 20 carbon atoms; $R_3$ is one or more halogen, alkyl of 1 to 20 carbon atoms, alkoxy of 1 to 20 carbon atoms, any other monovalent group.

Any of the foregoing coupler radicals may be ballasted by attachment to a polymer at some position other than the coupling position of said radicals.

Linking Groups

The linking group may be any divalent group that attaches to the coupling position of Cp and to the Dye such that the coupling-off group, comprising the linking group L and the Dye, -L-Dye, is released from the coupler upon reaction of oxidized developer with the coupling moiety and such that the Dye moiety is subsequently released from the coupling-off group. Linking groups suitable for the present invention have been described in U.S. Pat. Nos. 4,248,962, 4,409,323, and 4,840,884, the disclosures of which are incorporated herein by reference. The group L can contian moiteies and substituents which will permit control of one or more of the rate of reaction of Cp with oxidized color developing agent, the rate of diffusion of the coupling off group, and the rate of release of Dye.

The following linking groups are preferred, because of the latitude in reactivity they provide dye-releasing couplers and the controlled diffusibility they provide dyes released from said dye-releasing couplers subsequent to reaction of said couplers with oxidized developer and prior to separation of said linking group from said released dye:

L-1

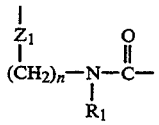

where n is 1–4, n is preferably 2 or 3;

L-2

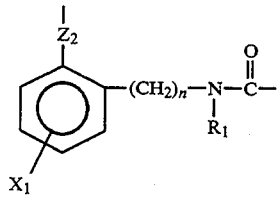

L-3

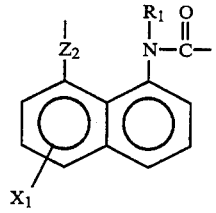

where n is 0 or 1;

L-4

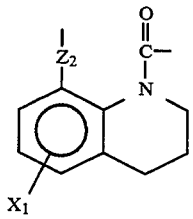

L-5

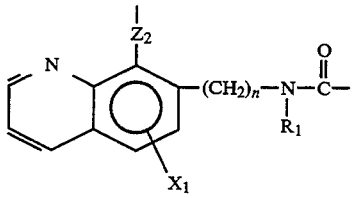

where n is 0 or 1;

L-6

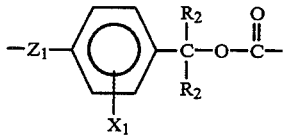

L-7

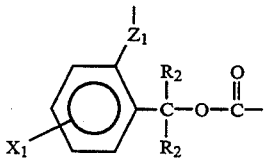

L-8

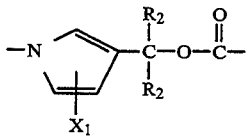

-continued

L-9

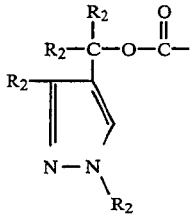

L-10

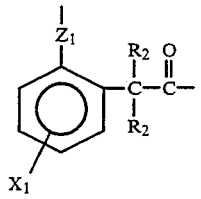

L-11

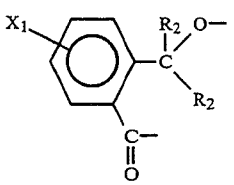

L-12

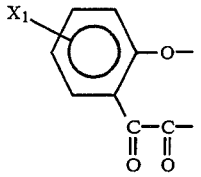

L-13

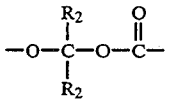

L-14

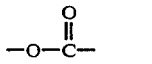

wherein $Z_1$ is

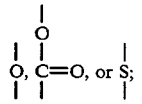

$Z_2$ is

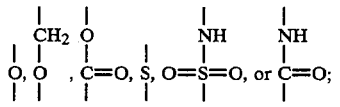

$R_1$ is hydrogen, alkyl of 1 to 20 carbon atoms, preferably lower alkyl of 1 to 4 carbon atoms, or aryl of 6 to 30 carbon atoms, preferably aryl of 6 to 10 carbon atoms;

each $R_2$ independently is hydrogen, alkyl of 1 to 25 carbon atoms, preferably lower alkyl of 1 to 4 carbon atoms, cycloalkyl, substituted cycloalkyl, or aryl of 6 to 30 carbon atoms, preferably aryl of 6 to 10 carbon atoms;

$X_1$ is hydrogen, cyano, fluoro, chloro, bromo, iodo, nitro, alkyl of 1 to 20 carbon atoms, aryloxy, alkoxycarbonyl, hydroxy, sulfonyl, acyl, alkoxy, sulfo, $—OR_2$, $—COOR_2$, $—CONHR_2$, $—NHCOR_2$, $—NHSO_2R_2$, $—SO_2NHR_2$, or $—SO_2R_2$.

Dye Radicals

The Dye moiety may be any diffusible dye or diffusible-dye precursor including azo, azamethine, methine, azopyrazolone, indoaniline, indophenol, anthraquinone, triarylmethane, alizarin, nitro, quinoline, or phthalocyanine dyes or precursors of such dyes such as leuco dyes or shifted dyes. Such dyes are described for example in U.S. Pat. Nos. 3,880,658, 3,931,144, 3,932,380, 3,932,381, 3,942,987, 4,248,962, and 4,840,884, the disclosures of which are incorporated herein by reference. Such dyes, in the present invention, also have a solubilizing group to insure diffusibility in an aqueous alkaline development environment. Such solubilizng groups include hydroxy, carboxy, substituted or unsubstituted amino, substituted or unsubstituted sulfonamido, substituted or unsubstituted sulfamoyl, sulfonic, sulfate, and phosphate groups.

Preferred dyes and dye precursors are azo, azamethine, methine, and indoaniline dyes and dye precursors, because of their ease of manufacture and excellent hues. Examples of such preferred dyes include the following; the asterisk denotes the point of attachment of the dye to the divalent linking group L:

DC-1

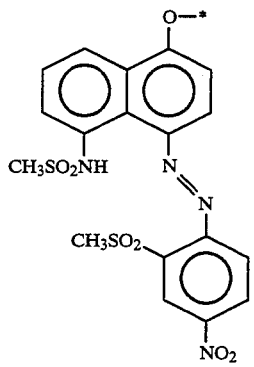

DC-2

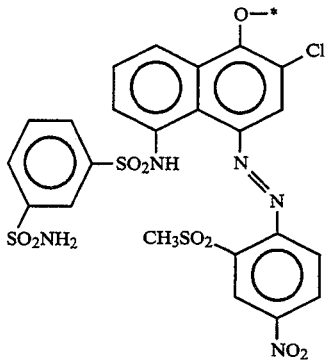

-continued
DC-3
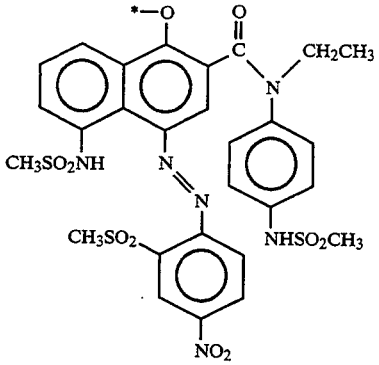
DC-4
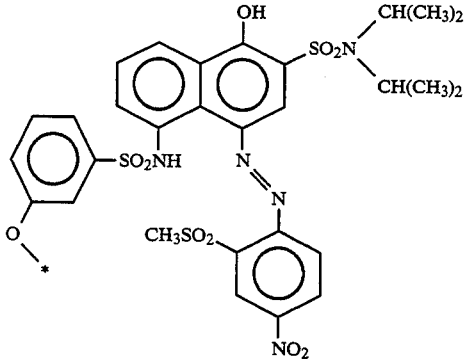
DM-1
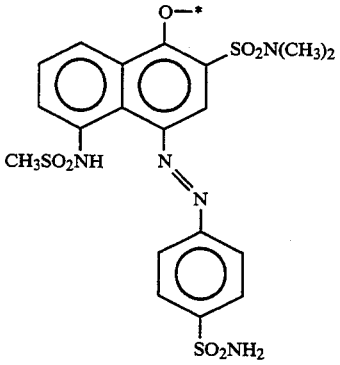
DM-2
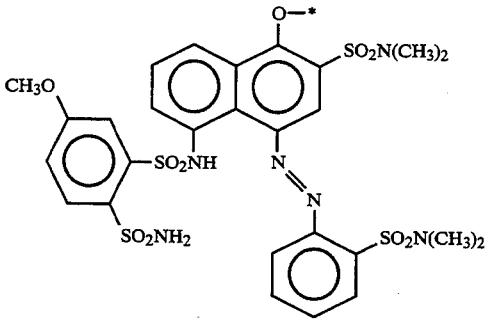
-continued
DM-3
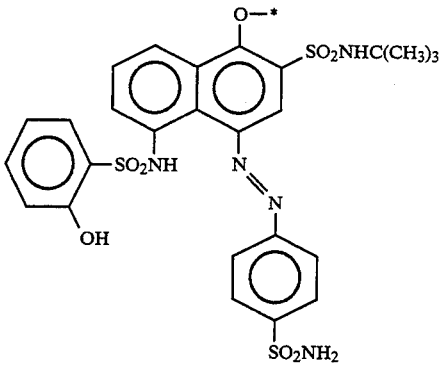
DY-1
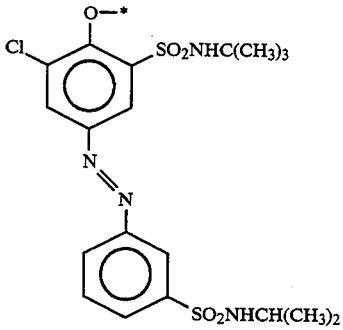
DY-2
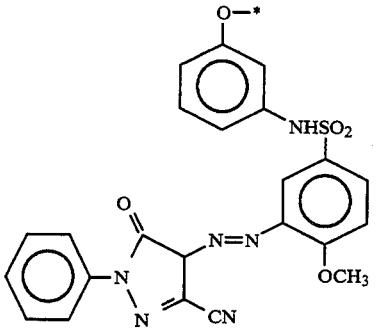
DY-3
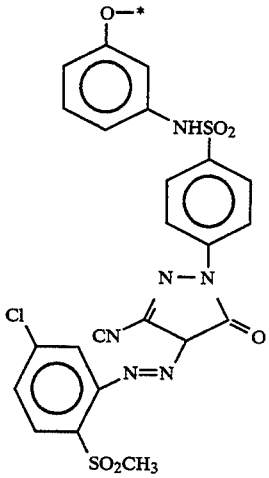

-continued

DY-4

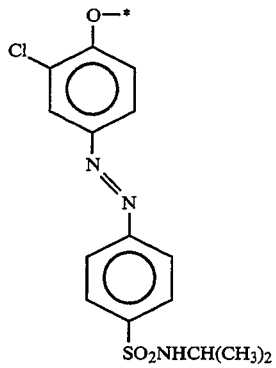

Color developing agents which are useful with the nondiffusing couplers and compounds of this invention include the following:

4-amino-N-ethyl-3-methyl-N-β-sulfoethyl)aniline
4-amino-N-ethyl-3-methoxy-N-(β-sulfoethyl)aniline
4-amino-N-ethyl-N-(β-hydroxyethyl)aniline
4-amino-N,N-diethyl-3-hydroxymethyl aniline
4-amino-N-methyl-N N-(β-carboxyethyl)aniline
4-amino-N,N-bis-(β-hydroxyethyl)aniline
4-amino-N,N-bis-(β-hydroxyethyl)-3-methyl-aniline
3-acetamido-4-amino-N,N-bis-(β-hydroxyethyl)aniline
4-amino-N-ethyl-N-(2,3-dihydroxypropoxy)-3-methyl aniline sulfate salt
4-amino-N,N-diethyl-3-(3-hydroxypropoxy)aniline

Barrier Layers

Certain polymers of this invention are used as barrier layers to diffusible dyes and their precursors. The barrier polymers of this invention contain ion forming functional groups in amounts from about $1\times10^{-5}$ to about $4\times10^{-3}$ moles/gram of polymer and preferably from about $5\times10^{-5}$ to about $2\times10^{-3}$ moles/gram of polymer. Additionally, the barrier polymers of this invention do not contain groups which significantly absorb, scavenge, or mordant diffusible dyes, for example, secondary, tertiary, or quaternary ammonium groups. The barrier polymer should contain a balance of hydrophobic and hydrophilic entities such that they are swellable, but not fully soluble in water or processing solutions as coated. They should also allow the passage of processing solutions, either when coated alone or in combination with gelatin. Further, they should be dispersible or soluble in water as formulated for coating. The molecular weight of said barrier polymers is preferably in the range of 50,000 to 1,000,000 so that said barrier polymers are practical to coat.

The barrier polymers may contain repeating units derived from any monomers which can be used in photographic elements provided the resulting polymer meets the ionic content requirement defined above and has the correct water swellability in the processing solutions. These can include, among others, water dispersible polyesters, polyamides, polyethers, polysulfones, polyurethanes, polyphosphazenes, and chemically modified naturally-occurring polymers such as proteins, polysaccharides, and chitins. Preferred monomers are vinyl monomers, particularly acrylate, methacrylate, acrylamide and methacrylamide monomers which includes analogs of said monomers, because such monomers are highly suitable for radical polymerization.

The more preferred barrier polymers contain repeating units of the formula-(A)-(B)-wherein wherein A is a hydrophobic ethylenically unsaturated monomer and B is an ionic hydrophilic ethylenically unsaturated monomer, because such hydrophobic/hydrophilic mixtures are effective in providing diffusible-dye reflection and processing solution permeability. A may be selected from, for example, vinyl ketones, alkylvinyl esters and ethers, styrene, alkylstyrenes, halostyrenes, acrylonitrile, butadiene, isoprene, chloroprene, ethylene and alkyl substituted ethylenes, alkyl substituted acrylamides, alkyl substituted methacrylamides, haloethylenes, and vinylidene halides. Examples of hydrophobic monomers are listed in Research Disclosure No. 19551, p. 301, July, 1980 hereby incorporated by reference. B may be selected from any class of vinyl monomers having an ion forming functional group and that can undergo free radical polymerization, for example, itaconic and fumaric acids, vinyl ketones, N-vinyl amides, vinyl sulfones, vinylethers, vinylesters, vinyl urylenes, vinyl urethanes, vinyl nitriles, vinylanhydrides, allyl amine, maleic anhydride, maleimides, vinylimides, vinylhalides, vinyl aldehydes, substituted styrenes, and vinyl heterocycles. Other examples of ionic monomers are listed in Research Disclosure No. 19551, p. 303, July 1980 hereby incorporated by reference. The more preferred monomers of group A and B are acrylamides, methacrylamides, acrylates, and methacrylates.

The ion forming functional groups of B may be ionic groups, ion forming functional groups or groups which can undergo a subsequent reaction resulting in the formation of an ionic group, e.g. by hydrolysis or by pH induced protonation. Any ion forming functional group will work in this invention provided its presence augments the water swellability of the polymer during processing. Suitable ion forming groups will be apparent to those skilled in the art. The ion forming groups can be either cationic or anionic and the polymers may contain monomers with opposite charges such that the polymers are zwitterionic.

Particularly preferred are polymers containing repeating units derived from ethylenically unsaturated monomers of the formula-$(A)_m$-$(B)_n$-.

A is a hydrophobic monomer having the structure

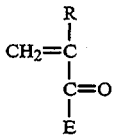

where R is hydrogen or methyl; E is $-OR_2$ or $-NR_3R_4$; $R_2$ is a substituted or unsubstituted straight, branched, or cyclic alkyl or aryl group of about 1 to 10 carbon atoms; $R_3$ and $R_4$ are independently selected from hydrogen or any $R_2$ group and $R_3$ and $R_4$ together contain at least 3 carbon atoms; and m is 0 to 99.5 mole percent. B is an ionic hydrophilic monomer of the formula

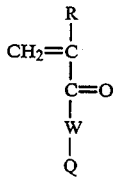

wherein R is hydrogen or methyl; W is $—OR_5$ or $—NR_6R_7$; $—R_5$ is a straight, branched, or cyclic alkylene or arylene group of 1 to about 10 carbon atoms; $R_6$ is hydrogen or a straight, branched, or cyclic alkyl or aryl group from 1 to about 6 carbon atoms; $R_7$ is a straight, branched or cyclic alkylene or arylene group of 1 to about 10 carbon atoms, n is 0.5 to 100 mole percent; and Q is an ionic functional group independently selected from:

(a) $—NH_2$ or the acid addition salt —NH2: HX, where X is an appropriate acid anion or (b) $—CO_2M$, $—SO_3M$, $—OSO_3M$, $—OPO_3M$, and—OM where M is an appropriate cation.

$R_2$, $R_3$, and $R_4$ of formula A may be substituted with any non-ion forming group that does not interfere with the hydrophobic nature of the monomer or prevent polymerization. Examples of substituents are halide, alkoxy, acryloxy, styryl, sulfoxyalkyl, sulfoalkyl, nitro, thio, keto, or nitrile groups. The monomers of group A may also contain reactive functional groups so that the polymers may perform other photographically useful functions common to interlayers between imaging layers and protective layers over imaging layers. $R_2$, $R_3$, $R_4$, $R_5$, $R_6$ and $R_7$ may be substituted with groups that can form heterocyclic rings. The straight, branched or cyclic alkyl groups of A and B include all isomeric forms and may contain one or more sites of unsaturation. The more preferred monomers of group A contain unsubstituted straight or branched alkyl groups of 4 to 8 carbon atoms and the more preferred monomers of group B contain straight or branched alkyl groups of 3 to 8 carbon atoms. The most preferred monomers of both A and B are acrylamides or methacrylamides monosubstituted on the amide nitrogen. For the polymers of this invention m is 0 to about 99.5 mole percent and n is about 0.5 to 100 mole percent.

The acid ions and cations of Q may be organic or inorganic. Appropriate anions include, but are not limited to, $Cl^-$, $Br^-$, $ClO_4^-$, $I^-$, $F^-$, $NO^-$, $HSO_4^-$, $SO_4^{2-}$, $HCO_3^-$, and $CO_3^{2-}$ with $Cl^-$ being most preferred. Appropriate cations include, but are not limited to, $H^+$, alkali metal, and ammonium, with $Na^+$ and $H^+$ being most preferred.

When the polymers of this invention are derived from monomers A and B of the above formula and both A and B are acrylamide or methacrylamide monomers monosubstituted on the amide nitrogen the polymers fall within a class of polymers known as Thenno Reversible Gelling (TRG) polymers. The TRG polymers are one preferred class of polymers in this invention and are described in detail in U.S. application Ser. No. 502,726 filed Apr. 2, 1990, hereby incorporated by reference. Any TRG polymer as described in the above application is included in this invention providing it falls within the parameters described herein. When the polymer is a TRG polymer m is preferably about 40 to 99 mole percent and n is preferably about 1 to about 60 mole percent.

Examples of preferred monomers from group A are N-isopropylacrylamide, N-t-butylacrylamide, N-butylacrylamide, N-t-butylmethacrylamide, N-(1,1-dimethyl-3-oxobutyl)-acrylamide, N-butylmethacrylate, 2-ethyl-hexylmethacrylate, and benzylmethacrylate. Examples of preferred monomers from group B are N-(3aminopropyl)methacrylamide hydrochloride, aminoethylmethacrylate hydrochloride, sulfo-ethyl methacrylate sodium salt, N-(2-sulfo-1,1-dimethyl-ethyl)acrylamide sodium salt and N-2-carboxyethylacrylamide.

The barrier polymers of this invention may also include repeating units derived from hydrophilic nonionic monomers to enhance their water swellability and to increase their permeability to processing solutions provided that ionic functional groups continue to comprise at least $1\times10^{-5}$ moles/gram of polymer. Any hydrophilic monomer that will undergo free radical polymerization is suitable provided it does not contain secondary, tertiary, or quaternary ammonium groups. Preferred monomers are ethylenically unsaturated monomers, for example, N-vinyl pyrrolidone, N-vinyl-e-caprolactam, vinyloxazolidone, vinyl menthyloxazolidone, maleimide, N-methylol-maleimide, maleic anhydride, N-vinylsuccinamide, acryloylurea, cyanomethylacrylate, 2-cyanoethyl acrylate, glycerylacrylate, acryloyloxypolyglycerol, allyl alcohol, vinyl benzyl alcohol, p-methanesulfonamidostyrene, and methylvinylether. Block copolymers formed from, for example, polymethylene oxide, polypropylene oxide, and polyurethanes, with acrylate or methacrylate end groups can also be used. The more preferred monomers are acrylate, methacrylate, acrylamide and methacrylamide monomers and their analogs.

Representative monomers include N-(isobutoxymethyl)acrylamide, methyl-2-acrylamide-2-methoxy acetate, N-hydroxypropylacrylamide, ethylacrylamidoacetate, N-acetamidoacrylamide, N-(m-hydroxyphenyl)-acrylamide, 2-acrylamide-2-hydroxymethyl-1,3-propane diol, and N-(3- or 5-hydroxymethyl-2-methyl-4-oxo-2-pentyl)acrylamide. Other suitable hydrophilic monomers are listed in Research Disclosure No. 19551, p.305, July 1980 hereby incorporated by reference. Examples of preferred hydrophilic nonionic monomers are acrylamide, methacrylamide, N,N-dimethylacrylamide, hydroxyethylacrylamide, hydroxyethyl acrylate, hydroxyethylmethacrylate, hydroxypropyl acrylate, hydroxypropylmethacrylate, and methylene-bis-acrylamide. The hydrophilic nonionic monomer may be 0 to about 70 mole percent and preferably about 10 to 65 mole percent.

The barrier polymer layers must also have enough physical integrity to survive processing intact. Those skilled in the art will recognize that many of the monomers discussed above contain structural elements that will meet this parameter. For example polymers containing the cationic hydrophilic monomer N-(3-aminopropyl)methacrylamide hydrochloride also crosslink in the presence of many gelatin hardeners. Barrier polymers of this invention, however, may also contain additional monomers having groups which can be crosslinked by conventional photographic gelatin hardeners. These monomers can include, but are not limited to, aldehydes, bis(vinylsulfonyl)compounds, epoxides, aziridines, isocyanates, and carbodimides. Preferred are monomers containing active methylene groups such as 2-acetoacetoxyethylmethacrylate, ethylmethacryloylacetoacetate, and N-2-acetoacetoxyethyl)acrylamide. Alternatively, di- or multi-functional monomers such as methylene-bisacrylamide or ethylene glycol-dimethacrylate may be used, whereby polymers are prepared as crosslinked colloidal particles that are swellable and dispersible in water. Particularly preferred barrier polymers, because of their ease of synthesis and because of their effectiveness in reflecting diffusible dyes, of this invention are comprised of monomers whose structures are shown below in Table 6, and are listed in Table 7 which provides the monomer feed ratios used, charge type, and also indicates which of the polymers are of the preferred TRG class.

The barrier polymers can be prepared by synthetic procedures well known in the art. The polymers of this invention may be coated in the conventional manner. The amount of permeability of the barrier layer may be adjusted by adding gelatin or other water soluble polymers to the layer. Such water soluble polymers may comprise up to 50 percent of the barrier layer, but preferably no more than 25 percent. This method of adjusting permeability is particularly useful with polymers containing a high proportion of hydrophobic monomers and can alleviate the need to prepare different polymers of varying desired levels of permeability. The permeability of the layer may also be adjusted by varying the thickness of the polymer or polymer/gelatin layer. It has also been noted that surfactants or surfactant-like compounds, used with the polymer may affect the permeability. The surfactants or surfactant-like compounds, for example 2,5-dihydroxy-4-(1-methylheptadecyl) benzenesulfonic acid-monopotassium salt, are not added directly to the barrier layer but may be utilized in other layers. These surfactant compounds may diffuse and become associated with the polymer layer and affect the hydrophobicity of the polymer layer. All surfactants appear to increase the hydrophobic nature of the subject polymer layers, but surfactants or surfactant-like compounds of opposite charge to the utilized polymer are more effective at reducing permeability. The TRG polymers described above are a particularly preferred class of polymers of this invention. Solutions of such polymers are advantageous for coating because they can either be heat thickened or chill thickened upon application to a film to form layers with sharp and distinct interfaces. The preparation of TRG polymers is more fully described in U.S. application Ser. No. 7/502,726, which is incorporated herein by reference.

TABLE 6

Monomers for Barrier Layer Polymers
$CH_2{=}C(XX)(YY)$

Hydrophobic Monomers

IPA (N-isopropylacrylamide)
XX = —H
YY = —(CO)—(NH)—$CH(CH_3)_2$
TBA (N-t-butylacrylamide)
XX = —H
YY = —(CO)—(NH)—$C(CH_3)_3$
NBA (N-butylacrylamide)
XX = —H
YY = —(CO)—(NH)—$C_4H_9$
TBMA (N-t-butylmethacrylamide)
XX = —$CH_3$
YY = —(CO)—(NH)—$C(CH_3)_3$
DOA (N-(1,1-dimethyl-3-oxobutyl)-acrylamide)
XX = —H
YY = —(CO)—(NH)—$C(CH_3)_2$—$CH_2$—(CO)—$CH_3$
NBM (N-butylmethacrylate)
XX = —$CH_3$
YY = —(CO)—O—$C_4H_9$
2EHM (2-ethyl-hexylmethacrylate)
XX = —$CH_3$
YY = —(CO)—O—$CH_2CH(C_2H_5)CH_2CH_2CH_2CH_3$
BZM (benzylmethacrylate)
XX = —$CH_3$
YY = —(CO)—O—$CH_2$-phenyl
AAM (2-acetoacetoxyethylmethacrylate; a crosslinker)
XX = —$CH_3$
YY = —(CO)—O—$CH_2CH_2$—O—(CO)—$CH_2$—(CO)—$C_4H_9$-n Neutral Hydrophilic Monomers A (acrylamide)
XX = —H
YY = —(CO)—$NH_2$
HEM (hydroxyethylmethacrylate)
XX = —$CH_3$
YY = —(CO)—O—$CH_2CH_2OH$
MBA (methylene-bis-acrylamide; difunctional)
$CH_2{=}CH$—(CO)—(NH)—$CH_2$—(NH)—(CO)—$CH{=}CH_2$ Cationic Hydrophilic Monomers APM (N-(3-aminopropyl)methacrylamide hydrochloride)
XX = —$CH_3$
YY = —(CO)—(NH)—$CH_2CH_2CH_2NH_3^+Cl^-$
AEM (aminoethylmethacrylate hydrochloride)
XX = —$CH_3$
YY = —(CO)—O—$CH_2CH_2NH_3^+Cl^-$ Anionic Hydrophilic Monomers SEM (sulfoethylmethacrylate sodium salt)
XX = —$CH_3$
YY = —(CO)—O—$CH_2CH_2SO_3^-Na^+$
SSA (N-(2-sulfo-1,1-dimethylethyl)acrylamide sodium salt)
XX = —$CH_3$
YY = —(CO)—(NH)—$C(CH_3)_2CH_2SO_3^-Na^+$
CEA (N-2-carboxyethylacrylamide)
XX = —H
YY = —(CO)—(NH)—$CH_2CH_2CO_2H$

TABLE 7

Monomer Composition of Barrier Layer Polymers

| Label | Type | Monomers | Monomer Ratio | TRG? | Ratio % |
|---|---|---|---|---|---|
| D | + | (IPA)(APM) | 90:10 | Yes | Mole |
| E | + | (IPA)(APM) | 92:8 | Yes | Mole |
| F | + | (IPA)(A)(APM) | 85:10:5 | Yes | Mole |
| G | + | (TBA)(APM) | 75:25 | Yes | Mole |
| H | + | (TBA)(APM) | 80:20 | Yes | Mole |
| I | + | (TBA)(APM) | 83:17 | Yes | Mole |
| J | + | (TBA)(APM) | 84:16 | Yes | Mole |
| K | + | (NBA)(APM) | 80:20 | Yes | Mole |
| L | + | (TBMA)(APM) | 80:20 | Yes | Mole |
| M | + | (TBA)(IPA)(APM) | 65:20:15 | Yes | Mole |
| N | + | (DOA)(APM) | 80:20 | Yes | Mole |
| O | + | (TBA)(DOA)(APM) | 60:20:20 | Yes | Mole |
| P | + | (IPA)(MBA)(APM) | 80:10:10 | Yes | Weight |
| Q | + | (NBM)(AEM)(HEM) | 50:15:35 | No | Weight |
| Qa | + | (NBM)(AEM)(HEM) | 50:30:20 | No | Weight |
| R | + | (NBM)(AEM)(HEM) | 40:25:35 | No | Weight |
| S | + | (NBM)(AEM)(HEM) | 26:22:52 | No | Weight |

TABLE 7-continued

Monomer Composition of Barrier Layer Polymers

| Label | Type | Monomers | Monomer Ratio | TRG? | Ratio % |
|---|---|---|---|---|---|
| T | + | (NBM)(AEM)(HEM) | 20:15:65 | No | Weight |
| U | − | (TBA)(A)(SSA) | 75:20:5 | Yes | Mole |
| V | − | (NBM)(SEM)(AAM)(HEM) | 60:5:10:25 | No | Weight |
| Va | − | (NBM)(SEM)(AAM)(HEM) | 70:2.5:10:17.5 | No | Weight |
| Vb | − | (BZM)(SEM)(AAM)(HEM) | 50:2.5:10:37.5 | No | Weight |
| Vc | − | (2EHM)(SEM)(AAM)(HEM) | 50:5:10:35 | No | Weight |
| Vd | − | (NEM)(SEM)(AAM)(HEM) | 50:5:10:35 | No | Weight |
| Ve | − | (BZM)(SEM)(AAM)(HEM) | 60:2.5:10:27.5 | No | Weight |
| W | +/− | (TBA)(CEA)(APM) | 76:8:16 | Yes | Mole |
| X | +/− | (TBA)(A)(IPA)(APM) | 76:8:16 | Yes | Mole |
| Y | +/− | (TBA)(A)(SSA)(APM) | 65:20:5:10 | Yes | Mole |

Other Components

In the following discussion of suitable materials for use in the emulsions, elements, and methods according to the invention, reference will be made to Research Disclosure, December 1989, Item 308119, published by Kenneth Mason Publications, Ltd., Emsworth, Hampshire PO10 7DQ, U.K. This publication will be identified hereafter as "Research Disclosure".

The silver halide emulsion employed in the elements of this invention can be either negative working or positive working. Examples of suitable emulsions and their preparation are described in Research Disclosure, Sections I and II and the publication cited therein. Examples of suitable vehicles for the emulsion layers and other layers of elements of this invention are described in Research Disclosure, Section IX and the publications cited therein. The composition of said silver halide is preferably 95 mole percent or greater silver chloride, and most preferably 99 mole percent or greater silver chloride.

The photographic elements of this invention or individual layers thereof can contain, for example, brighteners (see Research Disclosure, Section V), antifoggants and stabilizers (see Research Disclosure, Section VI), antistain agents and image dye stabilizers (see Research Disclosure, Section VII, paragraphs I and J), light absorbing and scattering materials (see Research Disclosure, Section VIII), hardeners (see Research Disclosure, Section IX), plasticizers and lubricants (see Research Disclosure, Section XII) antistatic agents (see Research Disclosure, Section XIII), matting agents (see Research Disclosure, Section XVI), and development modifiers (see Research Disclosure, Section XXI).

The photographic elements can be coated on a variety of supports such as described in Research Disclosure, Section XVII and the references described therein.

Photographic elements can be exposed to actinic radiation, typically in the visible region of the spectrum, to form a latent image as described in Research Disclosure, Section XVIII and then processed to form a visible dye image as described in Research Disclosure, Section XIX. Processing to form a visible dye image includes the step of contacting the element with a color developing agent to reduce developable silver halide and oxidizing the color developing agent. Oxidized color developing agent in turn reacts with the coupler to release a diffusible dye.

Said contacting of the element with a color developing agent comprises wetting at least the emulsion side of said element with a volume of processing solution that exceeds the swelling volume of the element. The requisite processing solution volume to element area ratio will preferably exceed 20 mL/m$^2$. This ratio will more preferably exceed 200 mL/m$^2$.

With negative working silver halide, the processing step described above gives a negative image. To obtain a positive (or reversal) image, this step can be preceded by development with a nonchromogenic developing agent to develop exposed silver halide, but not form dye, and then uniformly fogging the element to render unexposed silver halide developable. Alternatively, a direct positive emulsion can be employed to obtain a positive image. After image formation the element is subjected to a stop and wash bath that may be the same or different. Thereafter, the element is dried. Said stop, wash, or drying steps may be omitted.

The advantages of the present invention will become more apparent by reading the following Examples. The scope of the present invention is by no means limited by these Examples. The Examples are intended to be illustrative and not exhaustive in setting forth the invention.

EXAMPLES

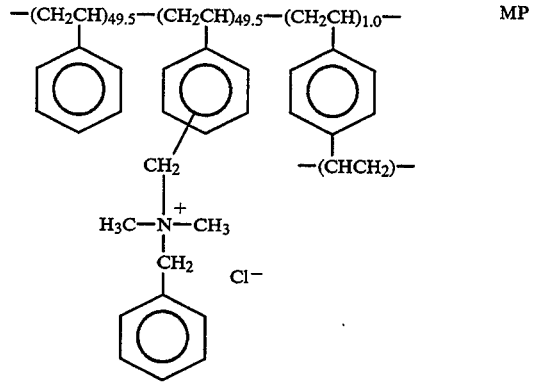

To a 190 L glass lined reactor equipped with variable speed agitator (reactor 1), automatic temperature control, vacuum, and nitrogen service was added about 104 kg of water with agitation. About 19.6 kg of water was added to a similarly equipped reactor (reactor 2). The space above the water, in each reactor, was evacuated and returned to atmospheric pressure under nitrogen three times. Thereafter nitrogen flow through the reactors was maintained. About 1.1 kg of aqueous Triton® 770 (a 30% by weight aqueous solution) was added to reactor 1, and the temperature control for reactor 1 was set to 64° C. To the other reactor (2) was added about 1.1 kg of Triton 770 (30% by weight) and about 304.6 g (1.30 mol) of 55% (w/w) 1,4-divinylbenzene. About 8.4 kg of styrene and about 12.2 kg of vinylbenzyl chloride were added to reactor 2 under vacuum, and pressure was returned to atmospheric with nitrogen. The temperature of reactor 2 was then set at 64° C. and the emulsion was maintained with agitation. About 19.7 g of sodium metabisulfite and aobut 162.8 g of potassium persulfate were then added to reactor 1. Within about two minutes, transfer of the emulsion in reactor 2 into reactor 1 was commenced at a rate of 330 mL/min. This transfer was continued for about 120 min.

About 9.9 g of sodium metabisulfite was dissolved in about 900 g of water. Another solution comprising about 16.4 g of potassium persulfate and about 900 g water was prepared. Fifteen minutes after completion of the emulsion charge addition to reactor 1, these two solutions were added to reactor 1. The reaction in reactor 1 was continued with stirring at 64° C. for an additional 3 hours, and then the temperature control was decreased to 20° C. When the reaction mixture temperature dropped to less than 30° C., the latex was filtered through a 50 μm bag filter into a clean 208 L drum. About 147 kg of aquous latex at about 14.75% (w/w) solids was obtained. Reactor 1 was then flushed with water, and the latex suspension was reintroduced into the reactor. Temperature control was set to 25° C. About 11.29 kg of N,N-dimethyl benzylamine was preweighed for subsequent addition. When the temperature of the reaction mixture reached 25° C., intoduction of the N,N-dimethyl benzylamine into reactor 1 was started at a rate of 50 mL/min. When this addition, lasting about an hour, was complete, the temperature controller for reactor 1 was set to 60° C. Agitation was adjusted throughout to maintain stirring while minimizing foaming. When the reaction mixture reached 60° C., the nitrogen feed was stopped, the reactor vent was closed, and stirring was maintained for about 18 hours. After this time the temperature was lowered to 20° C. and the nitrogen flow was resumed. After cooling the product was filtered through a 30 μm filter bag and about 183 kg of the desired latex suspenson of MP was obtained.

Preparation of Coating Base

A titania-pigmented reflection base was overcoated with a gelatin-mordant polymer mixture. A slurry comprising about 259.5 g of a 17% by weight aqueous suspension of the mordant polymer MP, about 46.4 g of 95% by weight type V, Class HX/001 doubly deionized gelatin (Rouseleau), and about 931.5 g distilled water was prepared at 50° C. and chill set. This chill set slurry was then noodled and washed for several hours. The washed noodles were combined, remelted, and chill set again to yield about 840 g of slurry about 4.2% (by weight) in gelatin and MP. Titania pigmented paper reflection base was subjected to a corona discharge treatment, and thereafter overcoated with a melt comprising equal weights of gelatin and MP. This melt was prepared by combining at 50° C. about 842 g of the aforesaid gelatin/MP slurry, about 10.2 g of spreading surfactant (10% by weight Olin-10G), and about 158.6 g of distilled water. This melt was coated on the reflection base at a coverage of about 91.3 mL/m$^2$ to yield a mordant covered base with coverages of about 3.22 g/m$^2$ in both gelatin and MP. A gelatin interlayer was then coated over this mordant layer. Type IV deionized bone gelatin was coated at a coverage of about 0.54 g/m$^2$ to form this interlayer. This base material was dried and stored until used in coating multilayer test elements.

SP3

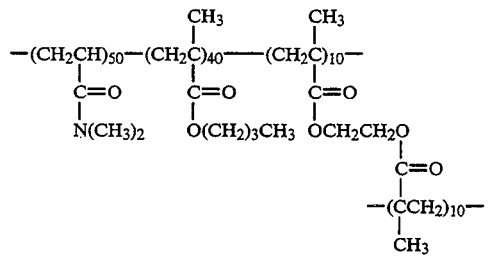

To a one-liter addition header was added about 800 mL of distilled water, about 100 g of N,N-dimethylacrylamide, about 80 g of n-butylmethacrylate, and about 20 g of ethylene glycol dimethacrylate. The suspension was bubbled with nitrogen for about 10 minutes and then about 20 mL of a 30% aqueous solution (by weight) of Sipex SB (Alcolac Corp.) were added. To a two-liter 3-necked flask were added about 800 mL of distilled water. This flask was placed in an 80° C. bath, stirred, and bubbled with nitrogen for 10 minutes. About 20 mL of 30% aqueous Sipex SB were added, and then about 2.0 g of potassium persulfate and about 0.6 g of sodium metabisulfite were added. Immediately thereafter the contents of the addition header were added over a 50 minute period. The resulting bluish-white latex was stirred at 80° C. under nitrogen for an additional hour. The latex was then cooled and dialyzed against distilled water for 16 hours to give a viscous suspension containing about 8.6% solids of the desired polymer SP3.

Stripping Layer

This layer was coated by preparing a solution comprising about 22.67 g of a 6.8% (by weight) aqueous suspension of SP3, about 1.85 g of a 50% (by weight) solution of SA1 in ethyl acetate, about 2.3 g of 10% (by weight) aqueous Olin 10G, about 6.94 g of 6.7% (by weight) aqueous TX-200, and about 891 g of distilled water. This solution was coated over the mordant layer at a coverage of about 32 mL/m$^2$ to yield coverages of about 32 mg/m$^2$ for SA1 and about 54 mg/m$^2$ for SP3.

Coupler 1

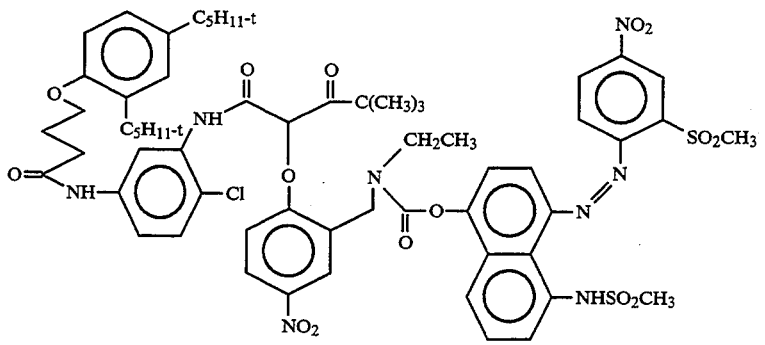

Intermediate i1 was prepared from the corresponding benzylamine (CAS Registry No. 125981-26-2) with phosgene under standard conditions. Intermediate i2, a cyan colored azo dye, was prepared by the coupling of 5-methanesulfonamido-1-naphthol (CAS Registry No. 54179-49-6) with the diazonium salt of 2-methanesulfonyl-4-nitroaniline (CAS Registry No. 96-74-2) under standard i1

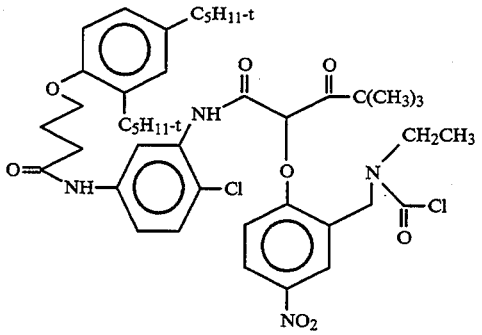

i2

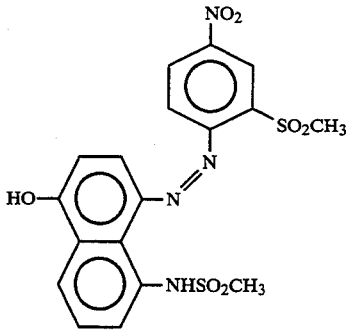

conditions. About 8.28 g of i1 and about 4.64 g of i2 were combined with 100 mL of pyridine and stiffed at ambient temperature for one day. The mixture was poured into cold dilute hydrochloric acid; ethyl acetate extraction work-up afforded a crude oil. Silica gel chromatography afforded Coupler 1 as a dark glass. This product was chromatographically homogeneous and displayed spectroscopic characterisitics consistent with the assigned structure. Combustion: [% Found (% Theory)]—C [58.5% (58.3%)]; H [5.6% (5.7%)]; N [8.7% (8.9%)].

Coupler 2

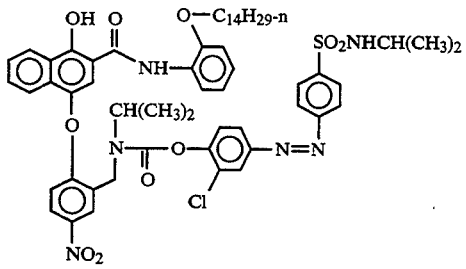

Intermediate i3 (CAS Registry No. 127344-30-3) was prepared by well documented methods. Intermediate i4, a yellow azo dye, was readily prepared by coupling 2-chlorophenol (CAS Registry No. 95-57-8) and the diazonium salt of 4-(2-propyl)sulfamoylaniline (CAS Registry No. 53668-35-2) under standard i3

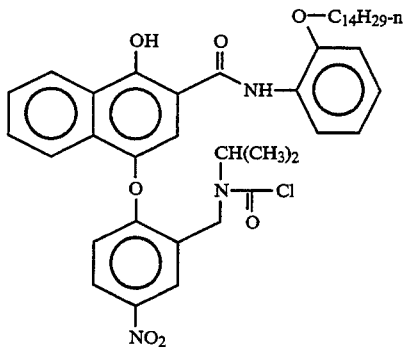

i4

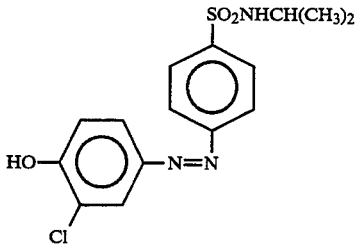

conditions. About 7.46 g of i3 and about 3.53 g of i4 were combined with 100 mL of pyridine and stirred at ambient temperature for one day. The mixture was poured into cold dilute hydrochloric acid; ethyl acetate extraction work-up afforded the crude product. Silica gel chromatography provided Coupler 2 as a yellow solid. This product was chromatographically homogeneous and displayed spectroscopic characterisitics consistent with the assigned structure. Combustion: [% Found (% Theory)]—C [64.3% (64.4%)]; H [5.8% (6.4%)]; N [7.9% (7.9%)].

Preparation of Coupler Dispersions

About 2.4 g of dye releasing coupler, about 4.8 g of N,N-diethyl lauramide, and about 4.8 g of ethyl acetate were combined and heated to provide an isotropic solution. An aqueous gelatin solution comprising about 3.2 g of 10% (w/w) Alkanol-XC (Du Pont), about 25.6 g of 12.5% (w/w) aqeuous gelatin, and about 39.2 g of water was prepared. This aqueous gelatin solution was then combined with the dye releasing coupler solution and passed through a Gaulin colloid mill five times. The resulting fine particle dispersion was chill set and stored in the cold until used for preparing coatings.

Coating of Light Sensitive Layers

The base with coated mordant layer, gel interlayer, and stripping layer described above was overcoated with a light sensitive layer comprising blue sensitized AgCl and dye releasing coupler of the present invention. Coupler 1 from the above described dispersion, was coated (Coating 1) at a level of 908 mg/m$^2$, and Coupler 2 from the above described dispersion was coated (Coating 2) at a level of 997 mg/m$^2$. These coatings were overcoated with a barrier layer, as described below and in Table 8.

TABLE 8

| Layer Structure 1 |
|---|
| VMX (966 mg/m$^2$) |
| gel (Type IV; 107 mg/m$^2$) |
| Coupler (908–997 mg/m$^2$) |
| Blue Sensitized AgCl (430 mg Ag/m$^2$ as AgCl) |
| gel (Type IV; 1.61 g/m$^2$) |
| SA1 (32 mg/m$^2$) |
| SP3 (54 mg/m$^2$) |
| MP (3.22 g/m$^2$) |
| gel (Type V; 3.22 g/m$^2$) |
| Reflection Base |

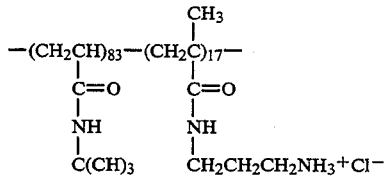

VMX

To a three-liter 3-necked flask, fitted with a stirrer and condenser, was added about 450 g of methanol and about 350 g of distilled water. The solution was degassed for about 30 minutes with nitrogen. About 105.4 g of t-butyl acrylamide (TBA), about 30.3 g of N-(3-aminopropyl) methacrylamide hydrochloride (APM), and about 0.35 g of AIBN (2,2'-azobisisobutylnitrile) were then added and the solution was stirred at about 60° C. under nitrogen for about 16 hours. A clear, viscous solution was obtained. The condenser was removed and about 1 kg of distilled water was added. The solution was stirred at 80° C. with a strong nitrogen sweep for 16 hours to remove the methanol. The solution was cooled to give a gel containing about 9.7% solids with an IV of 0.86 in 0.1M LiCl. This copolymer polymer of TBA and APM at mole ratio 83:17 (polymer I in Table 3) is designated "VMX" for reference purposes in the following.

Barrier Layer

Melts for coating the barrier layer were prepared by combining, at 50° C., 5% (by weight) aqueous VMX, 12.5% (by weight) aqueous gelatin, 10% (by weight) aqueous Olin 10G, Zonyl FSN, 1.8% (by weight) aqueous hardener (1,1'-[methylene bis(sulfonyl)]bis-ethene), and distilled water. The Olin 10G solution was typically added at a level corresponding to about 0.78% (by weight) of the total melt weight. The Zonyl FSN was added at a level corresponding to about 10% of the weight of aqueous Olin 10G solution added. Hardener was typically added at a level corresponding to about 1.5% by weight of the total gelatin coated in the respective multilayer coating. Such melts were used to overcoat the coupler/mordant/base coatings at coverages typically of about 54 mL/m$^2$ to yield about 966 mg VMX/m$^2$ and about 107 mg gelatin/m$^2$.

Processing and Sensitometry

These test coatings were exposed for 0.01 s to a tungsten light source (2850° K.) through a 0–3 density 21-step tablet and developed at 35° C. according to the following procedure. This process comprised development for 45 sec in a large volume of developer solution, a 60 sec stop treatment in a pH 4 borate buffer, a 60 sec rinse in a pH 7 phthalate buffer, washing in water for 90 sec, all at 35° C., and drying in a hot air dryer. The developer solution was prepared according to the following composition, where the developer pH @27° C. was adjusted to 10 or 11, depending on the development process desired for the particular example:

| | |
|---|---|
| Triethanolamine | 12.41 g |
| Phorwite REU (Mobay) | 2.3 g |
| Lithium polystyrene sulfonate (30% aqueous solution) | 0.30 g |
| N,N-diethylhydroxylamine (85% aqueous solution) | 5.40 g |
| Lithium sulfate | 2.70 g |
| KODAK Color Developing Agent CD-3 | 5.00 g |
| 1-Hydroxyethyl-1,1-diphosphonic acid (60% aqueous solution) | 1.16 g |
| Potassium carbonate, anhydrous | 21.16 g |
| Potassium bicarbonate | 2.79 g |
| Potassium chloride | 1.60 g |
| Potassium bromide | 7.00 mg |
| Water to make one liter | |

The test coatings, each approximately 35 mm×305 mm in dimension, were immersed in large volume (approximately 9 L) processing tanks in each of the development, stop, and wash steps. Strips of coating 1 (Examples 1 and 2) were developed at pH 10 for 45 sec and for 180 sec. Strips of coating 2 (Examples 3 and 4) were developed for 180 sec at pH 10 and at pH 11. After drying the barrier (overcoat) and imaging (emuslion and dye-releasing) layers (donor element) were removed (stripped) from the mordant/base layers (receiver element) using the method described by Texter et al. in U.S. application Ser. No. 7/805,717. The emulsion side of the dried and processed test coatings was contacted with the gel subbed (107 mg/m$^2$) side of an ESTAR adhesive element and passed at a rate of about 5 mm/s through pinch rollers heated to a surface temperature of 110° C. and held together under a pressure of 20 psi. The receiver elements were then pulled apart from the ESTAR adhesive element, and the donor layers were thereby stripped at the stripping layer and remained attached to the adhesive element. The barrier layer served to reflect diffusible dye and to minimize dye washout while said (integral) donor and receiver elements were immersed in large volume developing, stop, and wash baths. The dye reflection property of the barrier layer was illustrated in copending U.S. application Ser. No. 07/952,447 of Texter et al., entitled Barrier Layers for Dye Containment in Photographic Elements; the disclosure of said copending application is incorporated herein by reference. The donor layers contained undeveloped AgCl, the silver image, unreacted coupler, and a small fraction of the image dye formed. The receiver elements, on the other hand, retained most of image dye formed during color development. Reflection dye densities in the Drain and Dmax regions of the dye receiver were then read with a densitometer using status-A filters. These values are listed below in Table 9 for Examples 1–4 and illustrate that suitable image discrimination may be obtained in the elements of this invention.

TABLE 9

| | | Experimental Densitometry | | | |
|---|---|---|---|---|---|
| Example | Coating | Dev. Time (sec) | Dev. pH | Dmin | Dmax |
| 1 | 1 | 45 | 10 | 0.54 | 1.77 |
| 2 | 1 | 180 | 10 | 1.20 | 2.12 |
| 3 | 2 | 180 | 10 | 0.17 | 0.63 |
| 4 | 2 | 180 | 11 | 0.3 | 0.84 |

This invention has been described in detail with particular reference to preferred embodiments thereof, but it will be understood that variations and modifications can be effected within the spirit and scope of the invention.

What is claimed is:

1. A photographic color diffusion transfer element comprising a single dimensionally stable support, wherein said support comprises an opaque and light reflecting layer, and coated thereon in reactive association and in sequence (1) a mordant layer for binding diffusible dyes, (2) a stripping layer, (3) one or more layers comprising radiation sensitive silver halide and a diffusible-dye forming coupler, and (4) a barrier layer comprising a polymer that (a) allows the passage of solutions for processing said element when said element is contacted with an external processing bath, (b) impedes the diffusion out of said element of the diffusible dye formed from said diffusible-dye forming coupler, and (c) contains from about $1\times10^{-5}$ to about $4\times10^{-3}$ moles/gram of ion forming functional groups such that the barrier layer reflects diffusible dye, and wherein said diffusible-dye forming coupler is of the structure Cp-L-Dye wherein Cp is a coupler radical selected from the group comprising cyan dye forming radicals, magenta dye forming radicals, yellow dye forming radicals, black dye forming radicals, and colorless product forming radicals, said Cp being substituted in the coupling position with a divalent linking group, L;

Dye is a dye radical exhibiting selective absorption in the visible spectrum and contains a solubilizing group;

and where said -L-Dye group couples off upon reaction of said coupler radical with the oxidation product of a primary amine developing agent.

2. An element as in claim 1, wherein said stripping layer comprises stripping agent.

3. A photographic color diffusion transfer element comprising a single dimensionally stable transparent support, and coated thereon in reactive association and in sequence (1) one or more layers comprising radiation sensitive silver halide and a diffusible-dye forming coupler, (2) an opacifying light reflecting layer, (3) a mordant layer for binding diffusible dyes, and (4) a barrier layer comprising a polymer that (a) allows the passage of solutions for processing said element when said element is contacted with an external processing bath, (b) impedes the diffusion out of said element of the diffusible dye formed from said diffusible-dye forming coupler, and (c) contains from about $1\times10^{-5}$ to about $4\times10^{-3}$ moles/gram of ion forming functional groups such that the barrier layer reflects diffusible dye, and wherein said diffusible-dye forming coupler is of the structure Cp-L-Dye wherein Cp is a coupler radical selected from the group comprising cyan dye forming radicals, magenta dye forming radicals, yellow dye forming radicals, black dye forming radicals, and colorless product forming radicals, said Cp being substituted in the coupling position with a divalent linking group, L;

Dye is a dye radical exhibiting selective absorption in the visible spectrum and contains a solubilizing group;

and where said -L-Dye group couples off upon reaction of said coupler radical with the oxidation product of a primary amine developing agent.

4. An element as in claims 1 or 3, wherein said silver halide comprises greater than 95 mole percent silver chloride.

5. An element as in claims 1 or 3, wherein said mordant layer comprises an ultraviolet filter dye.

6. An element as in claims 1 or 3, wherein said mordant layer comprises a mordant polymer.

7. An element as described in claims 1 or 3, wherein said external bath comprises a volume greater than 20 mL per square meter of element contacting said bath.

8. An element as described in claims 1 or 3, wherein said external bath comprises a volume greater than 200 mL per square meter of element contacting said bath.

9. An element as described in claims 1 or 3, wherein said mordant layer comprises polymer comprising vinyl monomer units having tertiary amino groups or quaternary ammonium groups and wherein said vinyl monomer units are selected from the group consisting of:

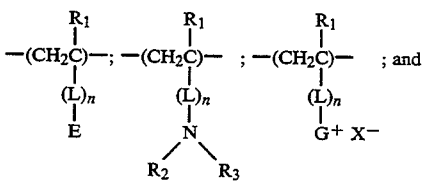

-continued

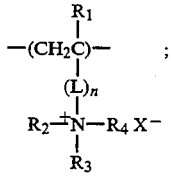

wherein $R_1$ is a hydrogen atom or a lower alkyl group having 1 to 6 carbon atoms; L represents a divalent linking group having 1 to 20 carbon atoms; E represents a hetero ring containing a carbon-nitrogen double bond; n is 0 or 1; $R_2$, $R_3$, and $R_4$ are the same or different and each represents an alkyl group having 1 to 12 carbon atoms or an aralkyl group having 7 to 20 carbon atoms; $G^+$ represents a hetero ring which is quaternized and contains a carbon-nitrogen double bond; $X^-$ represents a monovalent anion; and $R_2$ and $R_3$, $R_3$ and $R_4$, or $R_2$ and $R_4$ may form, together with the adjacent nitrogen atom, a cyclic structure.

10. An element as described in claims 1 or 3, wherein said mordant layer comprises mordant polymer at a coverage of 0.2–15 g/m$^2$.

11. An element as described in claims 1 or 3, wherein said mordant layer comprises mordant polymer at a coverage of 0.5–8 g/m$^2$.

12. An element as described in claims 1 or 3, wherein said mordant layer comprises mordant polymer with molecular weight in the range of 1,000–1,000,000.

13. An element as described in claims 1 or 3, wherein said mordant layer comprises mordant polymer with molecular weight in the range of 10,000–200,000.

14. An element as described in claims 1 or 3, wherein said mordant layer comprises hydrophilic binder.

15. An element as described in claims 1 or 3, wherein said hydrophilic binder is gelatin.

16. An element as described in claims 1 or 3, wherein said mordant layer comprises mordant polymer and hydrophilic binder at a weight-ratio of mordant polymer to hydrophilic binder in the range of 1:5 to 5:1.

17. An element as in claims 1 or 3, wherein one or more interlayers of any type are adjacent to any of said layers (1), (2), (3), and (4), and wherein said interlayers are permeable to aqueous alkaline processing solution.

18. An element as described in claims 1 or 3, wherein the polymer is comprised of repeating units derived from ethylenically unsaturated monomers.

19. An element as described in claim 18, wherein the polymer is comprised of repeating units derived from a hydrophobic acrylate, methacrylate, acrylamide or methacrylamide monomer.

20. An element as described in claim 19, wherein the polymer is further comprised of repeating units derived from a nonionic hydrophilic ethylenically unsaturated monomer.

21. An element as described in claim 19, wherein the polymer comprises repeating units of the formula $$-(A)_m-(B)_n-$$

wherein

A is a hydrophobic monomer having the structure

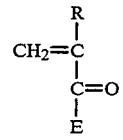

where

R is hydrogen or methyl;

E is $—OR_2$ or $—NR_3R_4$ $R_2$ is a substituted or unsubstituted straight, branched, or cyclic alkyl or aryl group of about 1 to 10 carbon atoms;

$R_3$ and $R_4$ are independently selected from hydrogen or any $R_2$ group; and $R_3$ and $R_4$ together contain at least 3 carbon atoms;

m is 0 to 99.5 mole percent;

wherein

B is an ionic hydrophilic monomer of the formula

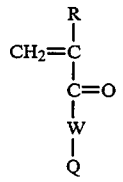

where

R is hydrogen or methyl;

W is $—OR_5$ or $—NR_6R_7$;

$R_5$ is a straight, branched, or cyclic alkylene or arylene group of 1 to about 10 carbon atoms;

$R_6$ is hydrogen or a straight, branched, or cyclic alkyl or aryl group from 1 to about 6 carbon atoms;

$R_7$ is a straight, branched or cyclic alkylene or arylene group of 1 to about 10 carbon atoms;

n is 0.5 to 100 mole percent;

Q is an ionic functional group independently selected from:

(a) $—NH_2$ or the acid addition salt $—NH_2{:}HX$, where X is an appropriate acid anion or (b) $—CO_2M$, $—SO_2M$, $—OSO_3M$, $—OPO_3M$ and —OM where M is an appropriate cation;

and wherein the polymer contains from about $1\times10^{-5}$ to about $4\times10^{-3}$ moles/gram of ion forming functional groups.

22. An element as described in claims 1 or 3, wherein said barrier layer comprises a polymer coated at a level of 100 mg/m$^2$ to 10 g/m$^2$.

23. An element as described in claim 22, wherein the barrier layer comprises a polymer coated at a level of 750 mg/m$^2$ to 2 g/m$^2$.

24. An element as described in claim 23, wherein the barrier polymer is selected from the group consisting of:

$(IPA)_{90}(APM)_{10}$;
$(IPA)_{92}(APM)_{8}$;
$(IPA)_{85}(A)_{10}(APM)_{5}$;
$(TBA)_{75}(APM)_{25}$;
$(TBA)_{80}(APM)_{20}$;
$(TBA)_{83}(APM)_{17}$;
$(TBA)_{84}(APM)_{16}$;
$(NBA)_{80}(APM)_{20}$;
$(TBMA)_{80}(APM)_{20}$;
$(TBA)_{65}(IPA)_{20}(APM)_{15}$;
$(DOA)_{80}(APM)_{20}$;
$(TBA)_{60}(DOA)_{20}(APM)_{20}$;

$(TBA)_{75}(A)_{20}(SSA)_5$;
$(TBA)_{76}(CEA)_8(APM)_{16}$;
$(TBA)_{65}(A)_{20}(CEA)_5(APM)_{10}$;
$(TBA)_{65}(A)_{20}(SSA)_5(APM)_{10}$;

where the subscripts indicate mole percents, and of:

$(IPA)_{80}(MBA)_{10}(APM)_{10}$;
$(NBM)_{50}(AEM)_{15}(HEM)_{35}$;
$(NBM)_{50}(AEM)_{30}(HEM)_{20}$;
$(NBM)_{40}(AEM)_{25}(HEM)_{35}$;
$(NBM)_{26}(AEM)_{22}(HEM)_{52}$;
$(NBM)_{20}(AEM)_{15}(HEM)_{65}$;
$(NBM)_{60}(SEM)_5(AAM)_{10}(HEM)_{25}$;
$(NBM)_{70}(SEM)_{2.5}(AAM)_{10}(HEM)_{17.5}$;
$(BZM)_{50}(SEM)_{2.5}(AAM)_{10}(HEM)_{37.5}$;
$(2EHM)_{50}(SEM)_5(AAM)_{10}(HEM)_{35}$;
$(NEM)_{50}(SEM)_5(AAM)_{10}(HEM)_{35}$;
$(BZM)_{60}(SEM)_{2.5}(AAM)_{10}(HEM)_{27.5}$;

and mixtures thereof where the subscripts indicate weight percents, and where IPA is N-isopropylacrylamide, TBA is N-t-butylacrylamide, NBA is N-butylacrylamide, TBMA is N-t-butylmethacrylamide, DOA is N-(1,1-dimethyl-3-oxobutyl)acrylamide, NBM is N-butylmethacrylate, 2EHM is 2-ethyl-hexylmethacrylate, BZM is benzylmethacrylate, AAM is 2-acetoacetoxyethylmethacrylate; a crosslinker, A is acrylamide, HEM is hydroxyethylmethacrylate, MBA is methylene-bis-acrylamide (difunctional), APM is N-(3-aminopropyl)methacrylamide hydrochloride, AEM is aminoethylmethacrylate hydrochloride, SEM is sulfoethylmethacrylate sodium salt, SSA is N-(2-sulfo-1,1-dimethylethyl)acrylamide sodium salt, and CEA is N-2-carboxyethylacrylamide.

25. An element as described in claims 1 or 3, wherein said coupler radical comprises at least one of the following:

C-I

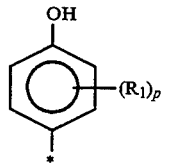

C-II

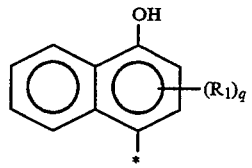

C-III

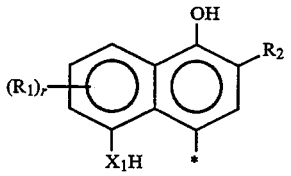

C-IV

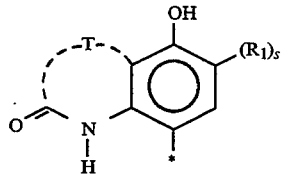

wherein:

$R_1$ has 0 to 30 carbon atoms and is alkyl, alkenyl, alkoxy, alkoxycarbonyl, halogen, alkoxycarbamoyl, aliphatic amido, alkylsulfamoyl, alkylsulfonamido, alkylureido, arylcarbamoyl, arylamido, arylsulfamoyl, arylsulfonamido, arylureido, hydroxyl, amino, carboxyl, sulfo, heterocylcic, carbonamido, sulfonamido, carbamoyl, sulfamoyl, ureido, acyloxy, aliphatic oxy, aliphatic thio, aliphatic sulfonyl, aromatic oxy, aromatic thio, aromatic sulfonyl, sulfamoyl amino, nitro, or imido;

$R_2$ is $-CONR_3R_4$, $-NHCOR_3$, $-NHCOOR_5$, $NHSO_2R_5$, $-NHCONR_3R_4$, or $NHSO_2R_3R_4$, wherein $R_3$ and $R_4$ each independently is selected from the group comprising hydrogen atom, aliphatic group having 1 to 30 carbon atoms, aromatic group having from 6 to 30 carbon atoms, and heterocyclic group having from 2 to 30 carbon atoms; $R_5$ is selected from the group comprising an aliphatic group having from 1 to 30 carbon atoms, an aromatic group having from 6 to 30 carbon atoms, and a heterocyclic group; $R_3$ and $R_4$ may join each other to form a heterocyclic ring; p is an integer from 0 to 3; q and r are integers from 0 to 4; s is an integer from 0 to 2.

$X_1$ is an oxygen atom, sulfur atom, or $R_6N<$, where $R_6$ is a hydrogen atom or a monovalent group; wherein said monovalent group is an aliphatic group having from 1 to 30 carbon atoms, aromatic group having from 6 to 30 carbon atoms, heterocyclic group having from 2 to 30 carbon atoms, carbonamido group having from 1 to 30 carbon atoms, imido group having from 4 to 30 carbon atoms, $-OR_7$, $-SR_7$, $-COR_7$. $-CONR_7R_8$, $-COCOR_7$, $-COCOR_7R_8$, $-COOR_7$, $-COCOOR_9$, $-SO_2R_9$, $-SO_2OR_9$, $-SO_2NR_7R_8$, or $-NR_7R_8$; wherein $R_7$ and $R_8$ each independently is a hydrogen atom, aliphatic group having from 1 to 30 carbon atoms, aromatic group having from 6 to 30 carbon atoms, or heterocyclic group having from 2 to 30 carbon atoms or $R_7$ and $R_8$ may join each other to form a heterocyclic ring; $R_9$ is an aliphatic group having from 1 to 30 carbon atoms, an aromatic group having from 6 to 30 carbon atoms, or a heterocyclic group having from 2 to 30 carbon atoms;

T is a group of atoms forming a 5-, 6-, or 7-membered ring by connecting with the carbon atoms wherein said group of atoms is selected from the group comprising $$-O-,\ -\underset{\underset{R'}{|}}{N}-,\ -\underset{\underset{O}{\|}}{C}-,\ -S-,\ -N{=},\ {=}N-,$$

$$-\underset{\underset{R'}{|}}{C}{=},\ {=}\underset{\underset{R'}{|}}{C}-,\ \text{or}\ -\overset{\overset{R'}{|}}{\underset{\underset{R''}{|}}{C}}-,$$

where R′ and R″ each independently is a hydrogen atom, alkyl group, aryl group, halogen atom, alkyloxy group, alkyloxycarbonyl group, arylcarbonyl group, alkylcarbamoyl group, arylcarbamoyl group, or cyano group.

26. An element as described in claims 1 or 3, wherein said coupler radical comprises at least one of the following:

M-I

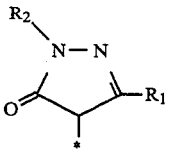

M-II

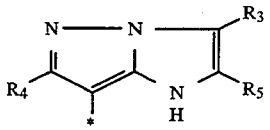

M-III

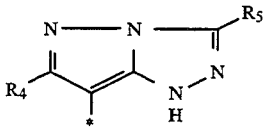

M-IV

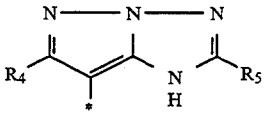

M-V

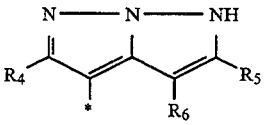

M-VI

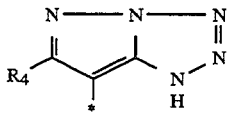

M-VII

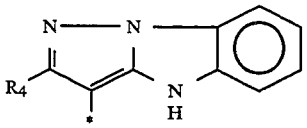

wherein:

$R_1$ and $R_2$ each independently is an alkyl group, a substituted alkyl group, an aryl group, a substituted arylgroup, an alkoxy group, an aryloxy group, an alkoxycarbonyl group, an acylamino group, a carbamoyl group, an alkylcarbamoyl group, a dialkylcarbamoyl group, an arylcarbamoyl group, an alkylsulfonyl group, an arylsufonyl group, an alkylsulfonamido group, an arylsulfonamido group, a sulfamoyl group, an alkylsulfamoyl group, a dialkylsulfamoyl group, an arylsulfamoyl group, an alkylthio group, an arylthio group, cyano group, nitro group, or a halogen atom;

$R_3$, $R_4$, $R_5$, and $R_6$ are each independently a hydrogen atom, hydroxyl group, an unsubstituted or substituted alkyl group having from 1 to 20 carbon atoms, an aryl group having from 6 to 20 carbon atoms, a heterocyclic group, an alkylamino group having from 1 to 20 carbon atoms, an acylamino group having from 2 to 20 carbon atoms, an anilino group an alkoxycarbonyl group having from 2 to 20 carbon atoms, an alkylcarbonyl group having from 2 to 20 carbon atoms, an arylcarbonyl group having from 7 to 20 carbon atoms, an alkylthio group having from 1 to 20 carbon atoms, an arylthio group having from 6 to 20 carbon atoms, a carbamoyl group having from 1 to 20 carbon atoms, a sulfamoyl group having from 0 to 20 carbon atoms, or an alkyl sulfonamido group having from 6 to 20 carbon atoms.

27. An element as described in claims 1 or 3, wherein said coupler radical comprises at least one of the following:

Y-I

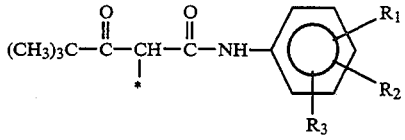

Y-II

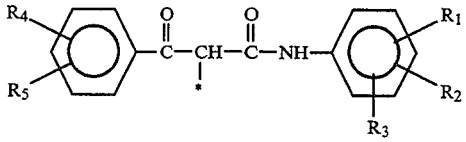

Y-III

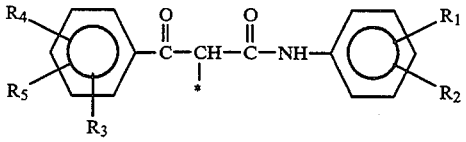

where:

$R_1$, $R_2$, $R_3$, $R_4$, and $R_5$ each independently is a hydrogen atom, an alkyl group, an alkenyl group, an alkoxy group, an alkoxycarbonyl group, a halogen atom, an alkoxycarbamoyl group, an aliphatic amido group, an alkylsulfamoyl group, an alkylsulfonamido group, an alkylureido group, an alkyl-substituted succinimido group, an aryloxy group, an aryloxycarbonyl group, an arylcarbamoyl group, an arylamido group, an arylsulfamoyl group, an arylsulfonamido group, an arylureido group, carboxyl group, sulfo group, nitro group, cyano group, or thiocyano group.

28. An element as described in claims 1 or 3, wherein said coupler radical comprises at least one of the following:

W-I

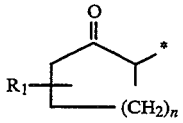

W-II

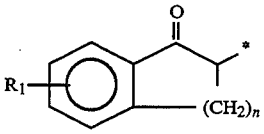

W-III

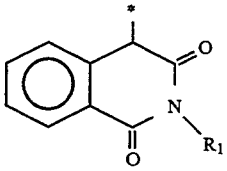

-continued

W-IV

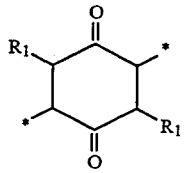

where $R_1$ is a ballast group and n is 1 or 2.

29. An element as described in claims 1 or 3, wherein said coupler radical comprises at least one of the following:

B-I

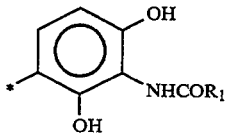

B-II

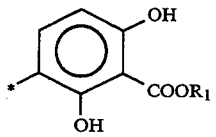

B-III

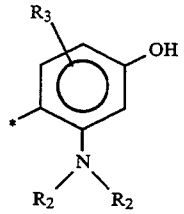

wherein $R_1$ is alkyl of 3 to 20 carbon atoms, phenyl, or phenyl substituted with hydroxy, halo, amino, alkyl of 1 to 20 carbon atoms, or alkoxy of 1 to 20 carbon atoms;

each $R_2$ is independently a hydrogen atom, halogen, alkyl of 1 to 20 carbon atoms, alkenyl of 1 to 20 carbon atoms, or aryl of 6 to 20 carbon atoms;

$R_3$ is one or more monovalent groups comprising halogen, alkyl of 1 to 20 carbon atoms, or alkoxy of 1 to 20 carbon atoms.

30. An element as described in claims 1 or 3, wherein said linking group comprises at least one of the following:

L-1

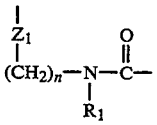

where n is 1–4, n is preferably 2 or 3;

L-2

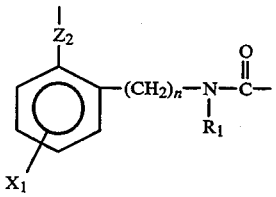

-continued

L-3

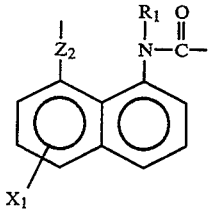

where n is 0 or 1;

L-4

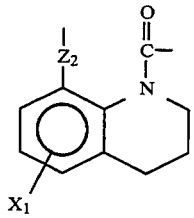

L-5

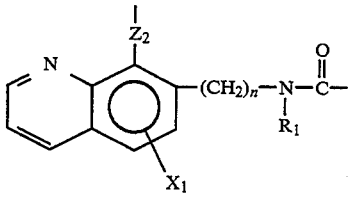

where n is 0 or 1;

L-6

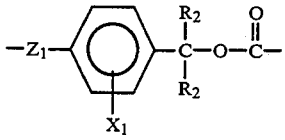

L-7

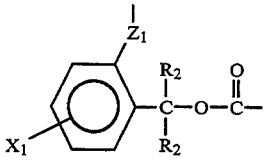

L-8

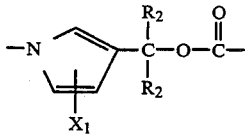

L-9

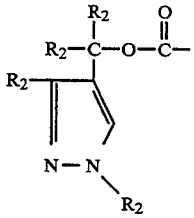

-continued

L-10

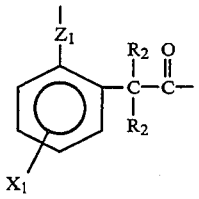

L-11

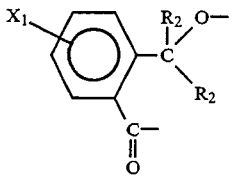

L-12

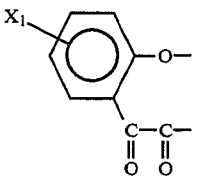

L-13

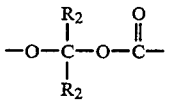

L-14

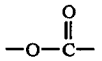

wherein $Z_1$ is

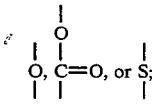

$Z_2$ is

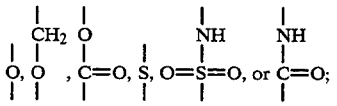

$R_1$ is a hydrogen atom, alkyl of 1 to 20 carbon atoms, or aryl of 6 to 30 carbon atoms;

each $R_2$ independently is a hydrogen atom, alkyl of 1 to 25 carbon atoms, cycloalkyl, substituted cycloalkyl, or aryl of 6 to 30 carbon atoms;

$X_1$ is a hydrogen atom, cyano, fluoro, chloro, bromo, iodo, nitro, alkyl of 1 to 20 carbon atoms, aryloxy, alkoxycarbonyl, hydroxy, sulfonyl, acyl, alkoxy, sulfo, $—OR_2$, $—COOR_2$, $—CONHR_2$, $—NHCOR_2$, $—NHSO_2R_2$, $—SO_2NHR_2$, or $—SO_2R_2$.

31. An element as in claims 1 or 3, wherein said Dye radical is selected from the group consisting of azo, azamethine, methine, or indoaniline dyes and dye precursors, and wherein said Dye radical comprises a solubilizing group selected from the group comprising hydroxy, carboxy, amino, substituted amino, sulfonamido, substituted sulfonamido, sulfamoyl, substituted sulfamoyl, sulfonic, sulfate, and phosphate groups.

32. An element as in claim 1, wherein said stripping layer comprises stripping polymer comprising at least one of the following:

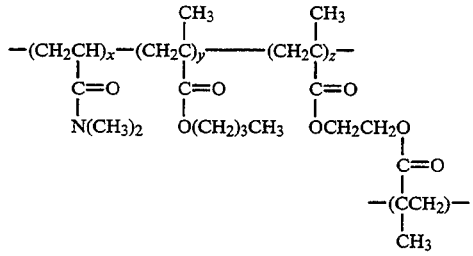

where x=30–70; y=20–60; z=0–20 mole percent,

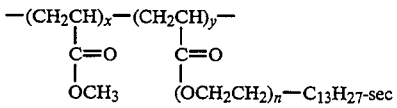

where x=20–80; y=20–80 mole percent, gum arabic, sodium alginate, pectin, cellulose acetate hydrogen phthalate, polyvinyl alcohol, hydroxyethyl cellulose, agarose, polymethacrylic acid, methyl cellulose, ethyl cellulose, methyl methacrylate, butyl methacrylate, and polyethylene oxide.

33. An element as in claim 32, wherein said stripping polymer is coated in the range of 0 to 500 mg/m$^2$.

34. An element as in claim 33, wherein said stripping polymer is coated in the range of 10 to 100 mg/m$^2$.

35. An element as in claim 2, wherein said stripping agent is coated at levels of 3–500 mg/m$^2$.

36. An element as in claim 2, wherein said stripping agent comprises:

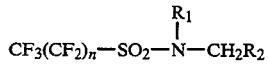

wherein $R_1$ is an alkyl group having from 1 to 6 carbon atoms, a substituted alkyl group having from 1 to 6 carbon atoms, an aryl group having from 6 to 10 carbon atoms, or a substituted aryl group having from 6 to 10 carbon atoms; $R_2$ is

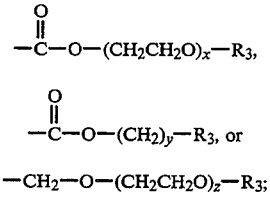

$R_3$ is H or $R_1$; n is an integer from 4 to 19; x and y each independently represents an integer of from 2 to 50; and z represents an integer of from 1 to 50.

37. An element as in claim 36, wherein $R_1$ is ethyl, $R_2$ is

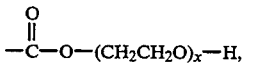

n is 6 to 8, and x is 25 to 50.

38. An element as in claim 36, wherein $R_1$ is ethyl, $R_2$ is $$-\overset{\overset{\displaystyle O}{\|}}{C}-O-(CH_2)_y-H,$$

n is 6 to 8, and y is 25 is 50.

39. A diffusion transfer process for forming a color photographic image comprising the steps of:

(a) providing an integral element comprising a single dimensionally stable layer comprising a coating support, and coated thereon in reactive association (1) a mordant layer for binding diffusible dyes, (2) one or more layers comprising radiation sensitive silver halide and a diffusible-dye releasing coupler, and (3) a barrier layer comprising a polymer that (i) allows the passage of solutions for processing said element when said element is contacted with an external processing bath, (ii) impedes the diffusion out of said element of the diffusible dye formed from said diffusible-dye forming coupler, and (iii) contains from about $1\times10^{-5}$ to about $4\times10^{-3}$ moles/gram of ion forming functional groups such that the barrier layer reflects diffusible dye, and wherein said diffusible-dye forming coupler is of the structure Cp-L-Dye wherein Cp is a coupler radical selected from the group comprising cyan dye forming radicals, magenta dye forming radicals, yellow dye forming radicals, black dye forming radicals, and colorless product forming radicals, said Cp being substituted in the coupling position with a divalent linking group, L;

Dye is a dye radical exhibiting selective absorption in the visible spectrum and comprises a solubilizing group;

and where the -L-Dye group couples off upon reaction of said coupler radical with the oxidation product of a primary amine developing agent;

(b) exposing said element to actinic radiation (c) processing said element by contacting said element to an external bath containing compounds selected from the group consisting of color developer compounds of the primary amine type and compounds which activate the release of incorporated color developers;

(d) washing said element to remove compounds imbibed in step (c).

40. A diffusion transfer process for forming a color photographic image comprising the steps of;

(a) providing an integral element comprising a single dimensionally stable layer comprising a coating support, wherein said support comprises an opaque and light reflecting layer, and coated thereon in reactive association (1) a mordant layer for binding diffusible dyes, (2) one or more layers comprising radiation sensitive silver halide and a diffusible-dye releasing coupler, and (3) a barrier layer comprising a polymer that (i) allows the passage of solutions for processing said element when said element is contacted with an external processing bath and (ii) impedes the diffusion out of said element of the diffusible dye formed from said diffusible-dye forming coupler, wherein said layers (1), (2), and (3) are coated in sequence upon said support, wherein a stripping layer is coated between layers (1) and (2), and wherein said diffusible-dye forming coupler is of the structure Cp-L-Dye wherein Cp is a coupler radical selected from the group comprising cyan dye forming radicals, magenta dye forming radicals, yellow dye forming radicals, black dye forming radicals, and colorless product forming radicals, said Cp being substituted in the coupling position, with a divalent linking group, L;

Dye is a dye radical exhibiting selective absorption in the visible spectrum and comprises a solubilizing group;

and where the -L-Dye group couples off upon reaction of said coupler radical with the oxidation product of a primary amine developing agent;

(b) exposing said element to actinic radiation;

(c) processing said element by contacting said element to an external bath containing compounds selected from the group consisting of color developer compounds of the primary amine type and compounds which activate the release of incorporated color developers;

(d) washing said element to remove compounds imbibed in step (c).

41. A diffusion transfer process for forming a color photographic image comprising the steps of:

(a) providing an integral element comprising a single dimensionally stable layer comprising a coating support, wherein said support comprises an optically transparent layer, and coated thereon in reactive association (1) a mordant layer for binding diffusible dyes, (2) one or more layers comprising radiation sensitive silver halide and a diffusible-dye releasing coupler, and (3) a barrier layer comprising a polymer that (i) allows the passage of solutions for processing said element when said element is contacted with an external processing bath and (ii) impedes the diffusion out of said element of the diffusible dye formed from said diffusible-dye forming coupler, wherein said layers (1), (2), and (3) are coated in sequence upon said support, wherein an opacifying light reflecting layer is coated between layers (1) and (2), and wherein said diffusible-dye foxing coupler is of the structure Cp-L-Dye wherein Cp is a coupler radical selected from the group comprising cyan dye forming radicals, magenta dye forming radicals, yellow dye, forming radicals, black dye forming radicals, and colorless product forming radicals, said Cp being substituted in the coupling position with a divalent linking group, L;

Dye is a dye radical exhibiting selective absorption in the visible spectrum and comprises a solubilizing group;

and where the -L-Dye group couples off upon reaction of said coupler radical with the oxidation product of a primary amine developing agent;

(b) exposing said element to actinic radiation (c) processing said element by contacting said element to an external bath containing compounds selected from the group consisting of color developer compounds of the primary amine type and compounds which activate the release of incorporated color developers;

(d) washing said element to remove compounds imbibed in step (c).

42. A process as in claim 39, wherein said support comprises an optically transparent layer, wherein said layers (2), (1), and (3) are coated in sequence upon said support, and wherein an opacifying light reflecting layer is coated between layers (2) and (1).

43. A process as in claims 40, 41, or 42, wherein said silver halide comprises greater than 95 mole percent silver chloride.

44. A process as described in claims 40, 41, or 42, wherein said external bath comprises a volume greater than 20 mL per square meter of element contacting said bath.

45. A process as described in claims 40, 41, or 42, wherein said external bath comprises a volume greater than 200 mL per square meter of element contacting said bath.

46. A process as described in claims 40, 41, or 42, wherein said mordant comprises polymer comprising vinyl monomer units having tertiary amino groups or quaternary ammonium groups and wherein said vinyl monomer units are selected from the group consisting of:

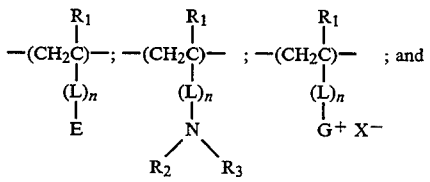

-continued

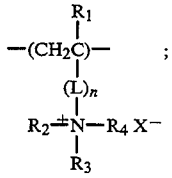

wherein $R_1$ is a hydrogen atom or a lower alkyl group having 1 to 6 carbon atoms; L represents a divalent linking group having 1 to 20 carbon atoms; E represents a hetero ring containing a carbon-nitrogen double bond; n is 0 or 1; $R_2$, $R_3$, and $R_4$ are the same or different and each represents an alkyl group having 1 to 12 carbon atoms or an aralkyl group having 7 to 20 carbon atoms; $G^+$ represents a hetero ring which is quaternized and contains a carbon-nitrogen double bond; $X^-$ represents a monovalent anion; and $R_2$ and $R_3$, $R_3$ and $R_4$, or $R_2$ and $R_4$ may form, together with the adjacent nitrogen atom, a cyclic structure.

47. A process as described in claims 40, 41, or 42, wherein said mordant layer comprises mordant polymer and hydrophilic binder at a weight-ratio of mordant polymer to hydrophilic binder in the range of 1:5 to 5:1.

48. A process as described in claims 40, 41, or 42, wherein the barrier layer comprises a polymer containing from about $1\times10^{-5}$ to about $4\times10^{-3}$ moles/gram of ion forming functional groups such that the barrier layer reflects diffusible dye and allows the passage of processing solutions for processing the silver halide emulsion layer.

49. A process as in claims 40, 41, or 42, wherein said Dye radical is selected from the group comprising azo, azamethine, methine, and indoaniline dyes and dye precursors, and wherein said Dye radical has a solubilizing group selected from the group comprising hydroxy, carboxy, amino, substituted amino, sulfonamido, substituted sulfonamido, sulfamoyl, substituted sulfamoyl, sulfonic, sulfate, and phosphate groups.

50. A process as in claims 40, 41, or 42, wherein one or more interlayers of any type are adjacent to any of said layers (1), (2), and (3), and wherein said interlayers are permeable to aqueous alkaline processing solution.

* * * * *